US007441289B2

(12) United States Patent
Loewenthal

(10) Patent No.: US 7,441,289 B2
(45) Date of Patent: Oct. 28, 2008

(54) SLIP NUT ASSEMBLY FOR ADJUSTABLE HEIGHT BED

(75) Inventor: Howard Loewenthal, Hinckley, OH (US)

(73) Assignee: Invacare Corporation, Elyria, OH (US)

( * ) Notice: Subject to any disclaimer, the term of this patent is extended or adjusted under 35 U.S.C. 154(b) by 0 days.

(21) Appl. No.: 10/865,656

(22) Filed: Jun. 10, 2004

(65) Prior Publication Data

US 2004/0221386 A1 Nov. 11, 2004

Related U.S. Application Data

(63) Continuation-in-part of application No. 10/695,250, filed on Oct. 27, 2003, now Pat. No. 6,997,082, which is a continuation-in-part of application No. 10/280, 927, filed on Oct. 25, 2002, now Pat. No. 6,983,495.

(51) Int. Cl.
*A61G 7/00* (2006.01)

(52) U.S. Cl. ..... 5/611; 5/11

(58) Field of Classification Search ..... 5/611, 5/616, 11; 74/424.78, 424.95; 269/181–182, 269/254 CS See application file for complete search history.

(56) References Cited

U.S. PATENT DOCUMENTS

| | | | | |
|---|---|---|---|---|
| 166,102 | A | 7/1875 | Hennaman et al. | |
| 1,275,695 | A | 8/1918 | Iverson | |
| 2,522,759 | A | 9/1950 | Lindquist | |
| 2,791,129 | A * | 5/1957 | Russell | 74/441 |
| 2,958,438 | A | 11/1960 | Severson | |
| 3,015,113 | A | 1/1962 | Wallen | |
| 3,105,246 | A | 10/1963 | Emrick | |
| 3,669,440 | A * | 6/1972 | Kartasuk et al. | 269/181 |
| 4,364,282 | A * | 12/1982 | Nilsson | 74/424.82 |
| 4,846,011 | A * | 7/1989 | Gaffney | 74/89.38 |
| 5,134,731 | A * | 8/1992 | Quintile et al. | 5/11 |

(Continued)

FOREIGN PATENT DOCUMENTS

| | | |
|---|---|---|
| GB | 855930 | 12/1960 |

(Continued)

OTHER PUBLICATIONS

International Search Report and Written Opinion for PCT/US2004/018735.

(Continued)

*Primary Examiner*—Fredrick Conley
(74) *Attorney, Agent, or Firm*—Calfee Halter & Griswold LLP

(57) ABSTRACT

An adjustable bed includes a universal, or interchangeable, bed end that can be used at either end of the bed and that can be connected with a motor drive assembly. The bed end may include a manual crank that is removably attached to the bed end. The bed end may include an elevating mechanism that includes a cross-beam or similar structure for transmitting motive force between fixed and movable portions of the bed end. The bed end may also include a new slip nut assembly for transmitting motive force from a lead screw. The bed may further include a reversible corner plate for allowing the bed end to be used facing in either direction. The bed end may also include a plastic cover that is washable and scratch resistant.

11 Claims, 14 Drawing Sheets

U.S. PATENT DOCUMENTS

| | | | | | |
|---|---|---|---|---|---|
| 5,461,935 | A | * | 10/1995 | Hill | 74/89.38 |
| 5,685,035 | A | | 11/1997 | Urness et al. | 5/611 |
| 5,704,249 | A | * | 1/1998 | Krauska | 74/89.38 |
| 5,713,091 | A | | 2/1998 | Houchin | 5/660 |
| 5,802,639 | A | | 9/1998 | Raasch et al. | 5/611 |
| 5,964,347 | A | | 10/1999 | Urness | 206/326 |
| 6,000,077 | A | | 12/1999 | Cyr | 6/618 |
| 6,230,344 | B1 | | 5/2001 | Thompson et al. | 5/611 |
| 6,983,495 | B2 | | 1/2006 | Snyder et al. | |
| 6,997,082 | B2 | | 2/2006 | Snyder et al. | |

FOREIGN PATENT DOCUMENTS

| | | |
|---|---|---|
| WO | WO 2004/037043 A2 | 5/2004 |
| WO | WO 2005/044053 | 5/2005 |

OTHER PUBLICATIONS

Written Opinion for PCT application No. PCT/US03/33781.
Information Disclosure Statement mailed Nov. 5, 2004 from U.S. Appl. No. 10/280,927, 3 pgs.
Information Disclosure Statement mailed Mar. 21, 2003 from U.S. Appl. No. 10/280,927, 3 pgs.
Office action dated Jan. 27, 2004 from U.S. Appl. No. 10/280,927.
Office action dated May 5, 2004 from U.S. Appl. No. 10/280,927.
Invacare: Electric and Manual Beds; Service Manual; From 93-152: P/N 51000M493: Rev. H (3) 599.
Declaration of John Bertrand executed Oct. 29, 2007 (3 pages) with attached Exhibits 1-4 (13 pages).

* cited by examiner

SLIP NUT ASSEMBLY FOR ADJUSTABLE HEIGHT BED

RELATED APPLICATION

This application is a continuation in part of U.S. application Ser. No. 10/695,250, filed Oct. 27, 2003 now U.S. Pat. No. 6,997,082, which is a continuation in part of U.S. application Ser. No. 10/280,927, filed Oct. 25, 2002 now U.S. Pat. No. 6,983,495, the entire disclosures of which are hereby incorporated by reference.

TECHNICAL FIELD

The present invention relates to an adjustable bed. In particular, the present invention relates to a bed having a bed spring or other portion that is vertically adjustable, for example, for use in home health care.

BACKGROUND OF THE INVENTION

Adjustable beds are often used in home health care. Such beds typically include a height adjustment mechanism that is operable to raise or lower the bed spring. The height adjustment mechanism may be manual or electric. A manual mechanism uses a hand crank to operate a gearbox to raise and lower the bed spring. An electric mechanism uses an electric motor that rotates a drive shaft or drive tube. The drive shaft is connected with gearboxes that face inward on the respective bed ends. When the motor is actuated, rotational force is transmitted to the bed ends to synchronously raise and lower movable portions of the bed ends that support the bed spring. One such type of adjustable bed end is shown in U.S. Pat. No. 5,134,731, the entire disclosure of which is incorporated herein by reference.

Since the rotational force acts in the same direction of rotation at both ends of the bed, identical head and foot bed ends are not used because their gearboxes would cause one bed end to raise and the other bed end to lower. As a result, separate head ends and foot ends are typically provided for an adjustable bed. This results in the need to manufacture and store two different kinds of bed ends, and can cause mistakes when delivering and setting up a bed in a patient's home.

SUMMARY OF THE INVENTION

The present invention relates to an adjustable bed and to various features of the bed. In various embodiments, the bed includes a universal, or interchangeable, bed end that can be used at either end of the bed and can be connected with an existing motor drive assembly. The bed end may include a manual crank that is removably attached to the bed end. The bed end may include an elevating mechanism that includes a cross-beam or similar structure for transmitting motive force between fixed and movable portions of the bed end. The bed end may also include a new slip nut assembly for transmitting and synchronizing motive force from a lead screw. The bed may further include a reversible corner plate for allowing the bed end to be used facing in either direction. The bed end may also include a plastic cover that is washable and scratch resistant.

BRIEF DESCRIPTION OF THE DRAWINGS

The foregoing and other features of the present invention will become apparent to one skilled in the art to which the present invention relates upon consideration the following description of the invention with reference to the accompanying drawings, in which.

DETAILED DESCRIPTION OF THE INVENTION

Figure 1:
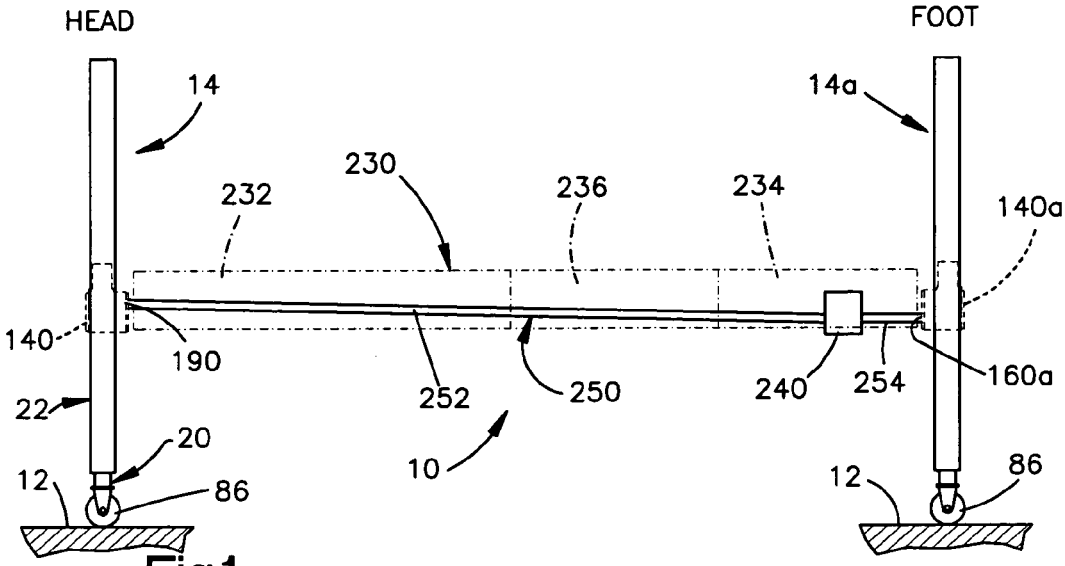
FIG. 1 is a schematic elevational view of one embodiment of an adjustable bed in accordance with the present invention.

The present invention relates to adjustable beds. In particular, the present invention relates to a bed having a bed spring or other portion that is vertically adjustable, for example, for use in home health care. As representative of the present invention, FIG. 1 illustrates one embodiment of a bed 10. The bed 10 is illustrated as being placed on a floor 12.

The bed 10 includes a bed end 14 that is located at the head end of the bed. The bed 10 also includes a bed end 14*a* that is located at the foot end of the bed. The bed end 14 is referred to herein as the "head end" of the bed 10. The bed end 14*a* is referred to herein as the "foot end" of the bed 10. The head end 14 of the bed 10 is identical to, and interchangeable with, the foot end 14*a* of the bed, as is discussed in more detail below.

The head end 14 of the bed 10 (FIG. 2) includes a fixed portion 20 and a movable portion 22. The fixed portion 20 of the head end 14 is that portion of the head end 14 that stays in position on the floor 12 when the height of the bed 10 is adjusted. The movable portion 22 of the head end 14 is that portion of the head end that moves vertically relative to the floor 12 and relative to the fixed portion 20 of the head end, when the height of the bed 10 is adjusted. This movement effects vertical movement of the portions of the bed on which the patient is located, as discussed below.

The fixed portion 20 of the head end 14 (FIG. 2) includes first and second inner legs 24 and 26 that are interconnected by a cross-beam 28. The inner legs 24 and 26 are identical to each other in construction and so their constituent parts are numbered identically.

Each one of the inner legs 24 and 26 has a square, tubular cross-sectional configuration with an inner side wall 30 that faces the opposite side of the bed end 14. Each one of the inner legs 24 and 26 has an upper end portion 32 and an opposite lower end portion 34. The inner legs 24 and 26 extend generally perpendicular to the floor 12 when the bed 10 is assembled as shown in the drawings.

The cross-beam 28 has a tubular, rectangular cross-sectional configuration that extends perpendicular to the inner legs 24 and 26 and parallel to the floor 12. The cross-beam 28 has opposite upper and lower side walls 48 and 50 and opposite inner and outer side walls. The cross-beam 28 also has first and second end walls 48 and 50 that close the ends of the cross-beam and provide a mounting structure for supporting the cross-beam.

The cross-beam 28 is connected between the upper end portions 32 of the inner legs 24 and 26, respectively. Specifically, the first end wall 48 of the cross-beam 28 is fixedly secured to the upper end portion 32 of the first leg 24, specifically, the inner side wall 30, by fastener structure that, in the illustrated embodiment, includes a plurality of bolts 52. In a similar manner, the second end wall 50 of the cross-beam 28 is fixedly secured to the upper end portion 32 of the second leg 26, specifically, the inner side wall 30, by fastener structure that, in the illustrated embodiment, includes a plurality of bolts 54. As a result, the cross-beam 28 and the first and second inner legs 24 and 26 are fixed to each other as one unit that rests on the floor 12 and that does not move vertically when the height of the bed 10 is adjusted as described below. These three pieces together form the fixed portion 20 of the head end 14. It should be understood that the cross-beam 28 could be configured differently, so long as it comprises structure that rigidly joins the inner legs 24 and 26 for transmitting force between the movable portions 22 of the bed end 14 and the fixed portion 20 of the bed end.

The movable portion 22 of the head end 14 of the bed 10 includes structural and operational parts, as well as decorative/covering parts. The decorative/covering parts are not shown in FIGS. 1-6, so that the structural and operational parts can be viewed. The decorative/covering parts are described below.

The movable portion 22 of the head end 14 includes a frame structure, or frame 60. The frame 60 includes an upper cross bar 62, a lower cross bar 64, and first and second outer legs 66 and 68.

The upper cross bar 62 has a tubular cross-sectional configuration that extends perpendicular to the outer legs 66 and 68 and parallel to the floor 12. The upper cross bar 62 has first and second end portions 70 and 72. The lower cross bar 64 has a tubular cross-sectional configuration that extends perpendicular to the outer legs 66 and 68 and parallel to the floor 12. The lower cross bar 64 has first and second end portions 74 and 76.

The first and second outer legs 66 and 68 of the frame 60 are identical to each other and so their constituent parts are numbered identically. Each one of the outer legs 66 and 68 has a square, tubular cross-sectional configuration with an inner major side wall 78 that faces the opposite side (left to right as viewed in FIG. 2) of the bed end 14. Each one of the outer legs 66 and 68 has an upper end portion 80 and an opposite lower end portion 82. The outer legs 66 and 68 extend perpendicular to the floor 12 when the bed 10 is assembled as shown in the drawings.

The first and second end portions 70 and 72 of the upper cross bar 62 are fixed to the upper end portions 80 of the first and second outer legs 66 and 68, respectively, by welding, for example. The first and second end portions 74 and 76 of the lower cross bar 64 are fixed to the first and second outer legs 66 and 68, respectively, by welding, for example. As a result, the upper and lower cross bars 62 and 64, and the first and second outer legs 66 and 68, are fixed to each other as one unit that is movable vertically when the height of the bed 10 is adjusted as described below.

The first and second inner legs 24 and 26 of the head end 14 of the bed 10 are telescopically received in the first and second outer legs 66 and 68 of the head end, respectively. The inner legs 24 and 26 are smaller in cross-sectional configuration than the outer legs 66 and 68 and are slidable within the outer legs. When the inner legs 24 and 26 are thus assembled with the outer legs 66 and 68, the lower end portions 34 of the inner legs project from the outer legs. Casters or other floor-engaging structure 86 (FIG. 1) may be fixed to the lower end portions 34 of the inner legs 24 and 26.

The inner side wall 78 of the first outer leg 66 is cut away or relieved in a known manner to allow travel clearance for the bolts 52 when the first inner leg 24 moves vertically relative to the first outer leg. In a similar manner, the inner side wall 78 of the second outer leg 68 is cut away or relieved in a known manner to allow travel clearance for the bolts 54 when the second inner leg 26 moves vertically relative to the second outer leg. As a result, the entire movable portion 22 of the head end 14, including the upper and lower cross bars 62 and 64 and the first and second outer legs 66 and 68, is movable vertically as one unit, relative to the fixed portion 20 of the head end, when the height of the bed 10 is adjusted as described below.

The movable portion of the head end 14 of the bed 10 includes a drive assembly 90 for receiving rotational force and, in response, moving the movable portion 22 of the head end vertically relative to the fixed portion 20 of the head end. The drive assembly 90 includes a gearbox 140, described below in detail, that is fixed in position on the lower cross bar 64 of the frame 60.

The drive assembly 90 also includes an externally threaded acme screw or lead screw 92. The lead screw 92 is mounted generally vertically in the frame 60. An upper end portion 94 of the lead screw 92 is supported on the upper cross bar 62 for rotational movement relative to the frame 60 about a drive axis 96. An upper screw pin 98 (FIG. 3) projects radially outward from the lead screw 92 near the upper end portion 94 of the lead screw. The upper end portion 94 of the lead screw 92 is not movable axially relative to the upper cross bar 62.

A lower end portion 100 of the lead screw 92 (FIG. 5) is supported on the gearbox 140 in a manner described below for rotation relative to the frame 60. The lower end portion 100 of the lead screw 92 includes an axially projecting tenon 102 that forms the lower terminal end of the lead screw. The lower end portion 100 of the lead screw 92 is not movable axially relative to the lower cross bar 64. As a result, the lead screw 92 is fixed for movement vertically with the frame 60 and with the other parts of the movable portion 22 of the head end 14.

The drive assembly 90 of the head end 10 also includes a slip nut assembly 104 (FIGS. 3 and 4) for transmitting force between the lead screw 92 and the cross-beam 28. The slip nut assembly 104 includes a slip nut housing 106. The nut housing 106 is fixed by bolts 108 to the upper side wall 40 of the cross-beam 28, at a location inside the cross-beam. As a result, the slip nut housing 104 is rigidly coupled by the cross-beam 28 to the inner legs 24 and 26.

The slip nut assembly 104 also includes a slip nut. The slip nut may be of the one-piece type shown in U.S. Pat. No. 5,134,731, entitled Adjustable Bed Having Adjustable Height Legs With Synchronization Feature, the entire subject matter of which is hereby incorporated by reference.

Figure 3:
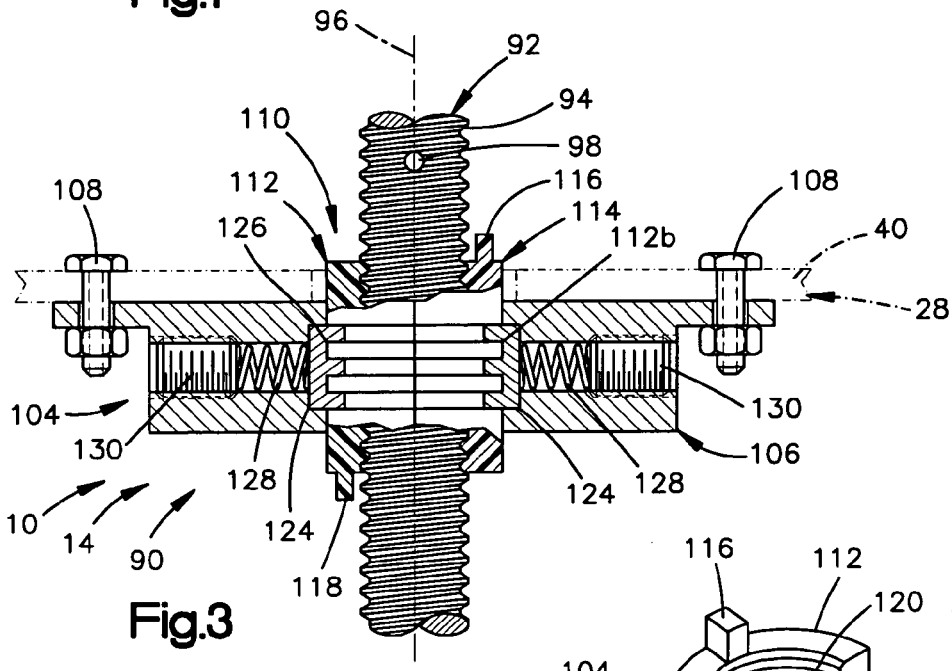
FIG. 3 is a sectional view of one embodiment of a slip nut assembly that forms part of the bed end of FIG. 2.
Figure 4:
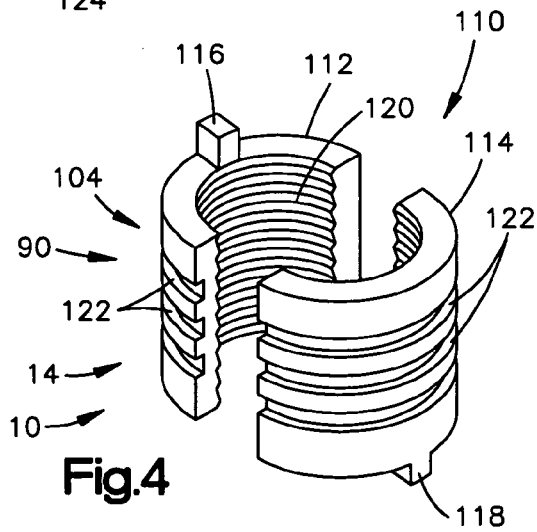
FIG. 4 is a perspective view of one embodiment of a slip nut that forms part of the slip nut assembly of FIG. 3.

Alternatively, and as preferred, the slip nut assembly 104 includes a slip nut 110 as shown and described herein. The slip nut 110 is formed as two separate pieces 112 and 114, as seen in FIGS. 3 and 4. The first and second slip nut halves 112 and 114 are formed by casting or molding. The first and second slip nut halves 112 and 114 are identical to each other.

An upper slip nut pin 116 is formed as one piece with the first slip nut half 112. A lower slip nut pin 118 is formed as one piece with the second slip nut half 114. The upper and lower slip nut pins 116 and 118 project axially from opposite upper and lower end surfaces of the slip nut 110. The two slip nut halves 112 and 114 when placed together as shown in FIG. 3 define an internal thread convolution 120 into which the lead screw 92 is threaded. A plurality of circumferential grooves 122 are formed on the outer surface of the slip nut 110. The grooves 122 do not extend helically but rather extend perpendicular to the drive axis 96.

The slip nut assembly 104 further includes a pair of pressure plates 124 mounted in the slip nut housing 106. The pressure plates 124 have internal grooves 126 that mesh with the external grooves 122 on the slip nut 110 to provide for relative rotation, without relative axial movement, between the slip nut and the pressure plates. The pressure plates 124 are movable laterally in the slip nut housing 106 (left to right as viewed in FIG. 3) but are blocked from rotation within the housing about the axis 96.

A pair of springs 128 are associated with the pressure plates 124. Each spring 128 is biased against its associated pressure plate 124 by a respective set screw 130 that is screwed into the slip nut housing 106. The springs 128 urge the pressure plates radially inward against the slip nut halves 112 and 114, which are, thereby, urged radially inward against the lead screw 92.

The gearbox 140 (FIGS. 2, 5 and 6) is fixed to the frame 60 and is operable to receive rotational force from outside the head end 14 of the bed 10 and, in response, effect rotation of the lead screw 92 about the drive axis 96. The gearbox 140 includes a housing 142. The gearbox housing 142 has a main body portion 144 and an output portion 146 that projects upward from the main body portion. The gearbox 140 is oriented relative to the frame 60 so that the drive axis 96 extends vertically into the output portion 146 of the housing 142. The gearbox 140 is fixed by one or more bolts 148 (FIG. 2), or other means, to the lower cross bar 64 of the frame 60 of the head end 14 of the bed 10.

Two bushings 150 and 152 (FIG. 5) in the main body portion 144 of the housing 142 support a lower input shaft 160 for rotation relative to the housing. The bushing 152 is supported on a vertically extending internal wall 154 of the housing 142. The wall 154 is, for clarity, not shown in FIG. 6.

The lower input shaft 160 is rotatable about an axis 162 that is perpendicular to the drive axis 96. A lower gear assembly 164 is fixed on the lower input shaft 160 for rotation with the lower input shaft, at a location between the two bushings 150 and 152. The lower gear assembly 164 includes a spur gear 166 and a bevel gear 168.

The lower input shaft 160 has first and second opposite end portions 170 and 172. A pair of lower drive pins 174 project radially from the lower input shaft 160 at diametrically opposite locations on the first end portion 170. The lower drive pins 174 are fixed for rotation with the lower input shaft 160. A pair of second drive pins 176 project radially from the second end portion 172 of the lower input shaft 160. The second drive pins 176 are fixed for rotation with the lower input shaft 160.

Two bushings 180 and 182 in the main body portion 144 of the housing 142 support an upper input shaft 190 for rotation relative to the housing. The bushing 180, which is located above the bushing 152 of the lower input shaft 160, is supported on the internal wall 154. The upper input shaft 190 is rotatable about an axis 192 that is perpendicular to the drive axis 96 at a location above and parallel to the lower input shaft 160 and its axis 162. As a result, the upper input shaft 190 is located between the lower input shaft 160 and the output portion 146 of the gearbox housing 142.

An upper gear assembly 194 is fixed on the upper input shaft 190 for rotation with the upper input shaft, at a location between the two bushings 180 and 182. The upper gear assembly 194 includes a spur gear 196 and a bevel gear 198. The upper input shaft 190 has first and second opposite end portions 200 and 202. A pair of upper drive pins 204 project radially from the upper input shaft 190 at diametrically opposite locations on the first end portion 200. The upper drive pins 204 are fixed for rotation with the upper input shaft 190.

The upper gear assembly 194 on the upper input shaft 190 is in meshing engagement with the lower gear assembly 164 on the lower input shaft 160. Specifically, the spur gear 196 on the upper gear assembly 194 is in meshing engagement with the spur gear 166 of the lower gear assembly 164. As a result, rotation of the lower input shaft 160 in either direction about its axis 162 results in rotation of the upper input shaft 190 in the opposite direction of rotation about its own axis 192. Similarly, rotation of the upper input shaft 190 in either direction about its axis 192 results in rotation of the lower input shaft 160 in the opposite direction of rotation about its own axis 162.

The output portion 146 of the housing 142 supports an output gear assembly 208. The output gear assembly 208 includes an output bevel gear 210 that is in meshing engagement with the bevel gear 198 on the upper input shaft 190. The output bevel gear 210 is supported in the output portion 146 of the housing 142, by one or more bushings 212, for rotation about the drive axis 96. An upwardly opening mortise 214 is formed in the output bevel gear 210. The tenon 102 on the lower end portion 100 of the lead screw 92 extends into the mortise 214 in the output bevel gear 210. As a result, the output bevel gear 210 is fixed for rotation with the lead screw 92 about the drive axis 96. Therefore, rotation of either the lower input shaft 160 or the upper input shaft 190 results in rotation of the lead screw 92 about the drive axis 96.

The gearbox housing 142 has several access ports for the input shafts 160 and 190. The main body portion 144 of the gearbox housing 142 has a main access opening 220 adjacent the first end portions 200 and 170 of the upper and lower input shafts 190 and 160, respectively. The main access opening 220 faces the foot end **14*a* of the bed 10 when the bed is assembled, as shown in FIG. 1. A movable door or cover 222 is pivotally connected to the gearbox housing 142. The door 222 is movable between a first position as shown in solid lines in FIG. 5 and a second position as shown partially in dash-dot lines in FIG. 5. In the first position, the door 222 covers the lower input shaft 160 and makes the upper input shaft 190 accessible from the exterior of the gearbox 140. In the second position, the door 222 covers the upper input shaft 190 and makes the lower input shaft 160 accessible from the exterior of the gearbox 140**.

The main body portion 144 of the gearbox housing 142 has a secondary access opening 224 adjacent the second end portion 172 of the lower input shaft 160. The secondary access opening 224 faces away from the foot end 14*a* of the bed 10 when the bed is assembled. A movable door or cover 226 is pivotally connected to the gearbox housing 142. The door 226 is movable between a first or closed position as shown in solid lines in FIG. 5 in which the door covers the second end portion 172 of the lower input shaft 160, and a second or open position (not shown) in which the door is opened and the lower input shaft 160 is accessible from the exterior of the gearbox 140.

The foot end 14*a* of the bed 10 (FIG. 1) is identical in construction to the head end 14. Corresponding parts of the foot end 14*a* are identified herein with reference numerals identical to those of the corresponding parts of the head end 14, but having the suffix "a" attached.

The foot end 14*a* of the bed 10 is interchangeable with the head end 14. When the bed 10 is assembled as in FIG. 1, the main access opening 220*a* of the gearbox 140*a* of the foot end 14*a* of the bed faces toward the main access opening 220 of the gearbox 140 of the head end 14 of the bed.

Because the head end 14 and the foot end 14*a* are identical, the main access opening 220*a* of the foot end gearbox 140*a* is at the same height off the floor 12 as the main access opening 220 of the head end gearbox 140. The lower input shaft 160*a* of the foot end gearbox 140*a* is at the same height off the floor 12 as the lower input shaft 160 of the head end gearbox 140. The upper input shaft 190*a* of the foot end gearbox 140*a* is at the same height off the floor 12 as the upper input shaft 190 of the head end gearbox 140.

The bed 10 includes a spring assembly 230 for supporting a mattress (not shown) on which the patient lies. The spring assembly shown includes a head spring 232, a foot spring 234, and a knee unit 236; other spring assemblies can be used. The several parts of the spring assembly 230 may be pivotable relative to each other and relative to the head end 14 and the footend 14*a*, in a known manner. The spring assembly 230 is supported by brackets on the movable portions 22 and 22*a* of the head end 14 and the foot end 14*a*, respectively, in a known manner, for vertical movement with the movable portions of the head end and the foot end.

The foot spring 234 supports an electric motor shown schematically at 240 (FIG. 1). The electric motor 240 is actuatable in a known manner by one or more controls, such as a pendant (not shown), to raise or lower the spring assembly 230 in a manner described below.

The bed 10 includes a drive tube assembly 250 for transmitting rotary force from the electric motor 240 to the head end 14 of the bed, and from the electric motor 240 to the foot end 14*a* of the bed. The drive tube assembly 250 includes a first drive tube section 252. The first drive tube section 252 extends between and interconnects the motor 240 and the head end 14 of the bed 10. The drive tube assembly 250 also includes a second drive tube section 254. The second drive tube section 254 extends between and interconnects the motor 240 and the foot end 14*a* of the bed 10.

The first drive tube section 252 is connected with the motor 240 in a known manner so that the first drive tube section is rotatable in a first direction of rotation, relative to both the head end 14 of the bed and the foot end 14*a* of the bed, upon "raising" actuation of the motor. The first drive tube section 252 is rotatable in a second direction of rotation opposite the first direction, upon "lowering" actuation of the motor 240.

The second drive tube section 254 is connected with the motor 240 in a known manner so that the second drive tube section is rotatable in the same first direction of rotation upon "raising" actuation of the motor, and rotatable in the same second direction of rotation opposite the first direction, upon "lowering" actuation of the motor. Thus, the first drive tube section 252 and the second drive tube section 254 are coupled for rotation with each other in the same direction of rotation, relative to the head end 14 and the foot end 14*a* of the bed 10, upon actuation of the electric motor 240.

A typical position for the parts of the bed 10 is shown schematically in FIG. 1. The first drive tube section 252 extends from the electric motor 240 to the upper input shaft 190 of the gearbox 140 on the head end 14 of the bed 10, as shown in dash-dot lines in FIG. 5. The drive pins 204 on the upper input shaft 190 of the gearbox 140 of the head end 14 couple the upper input shaft for rotation with the first drive tube section 252.

The second drive tube section 254 extends from the electric motor 240 to the lower input shaft 160*a* (not shown) of the gearbox 140*a* on the foot end 14*a* of the bed 10. The drive pins 174*a* (not shown) on the upper input shaft 160*a* of the gearbox 140*a* of the foot end 14*a* couple the lower input shaft 160*a* for rotation with the second drive tube section 254.

As a result, the connection between the drive tube assembly 250 and the head end 14 of the bed 10 is at a different vertical height off the floor 12 than the connection between the drive tube assembly and the foot end 14*a* of the bed, even though the two gearboxes 140 and 140*a* are each, as a whole, at the same vertical height off the floor.

Upon actuation of the motor 240 in a direction of rotation so as to raise the bed 10, the drive tube assembly 250 rotates in a first direction of rotation relative to the head end 14 and the foot end 14*a* of the bed. The first drive tube section 252 and the second drive tube section 254 both rotate in the first direction of rotation. The first direction of rotation is generally perpendicular to the axes of rotation 96 and 96*a* of the lead screws 92 and 92*a*, respectively.

Figure 6:
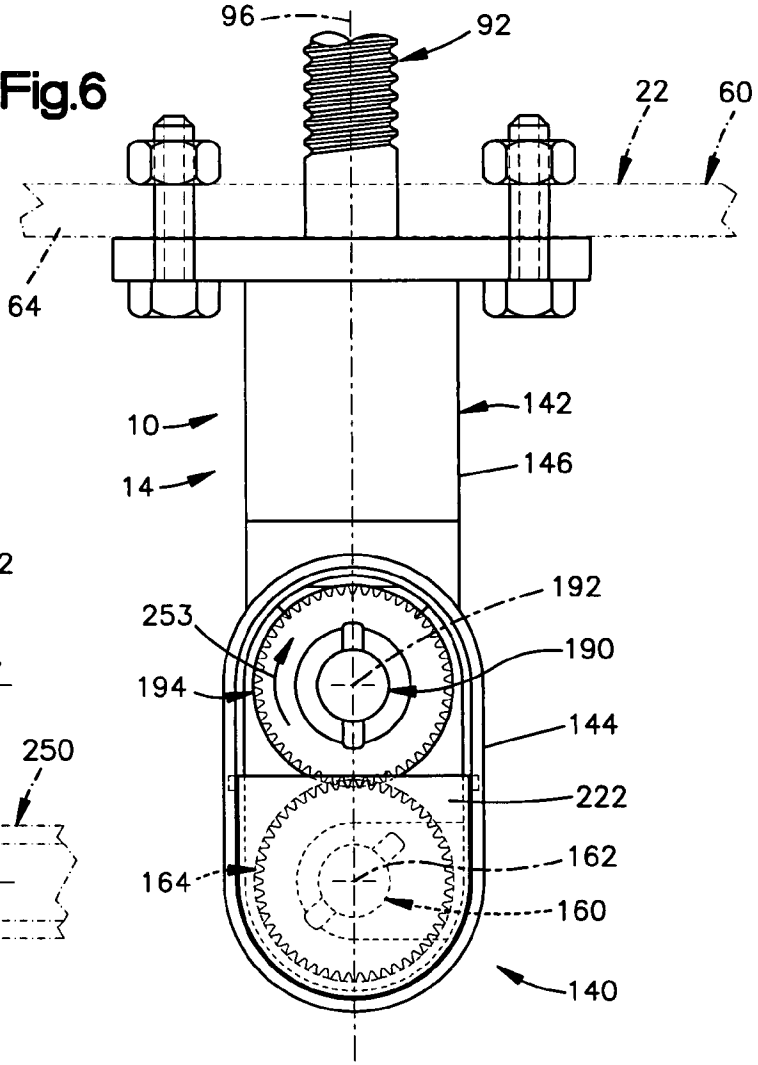
FIG. 6 is an elevational view of the gearbox of FIG. 5.
Figure 5:
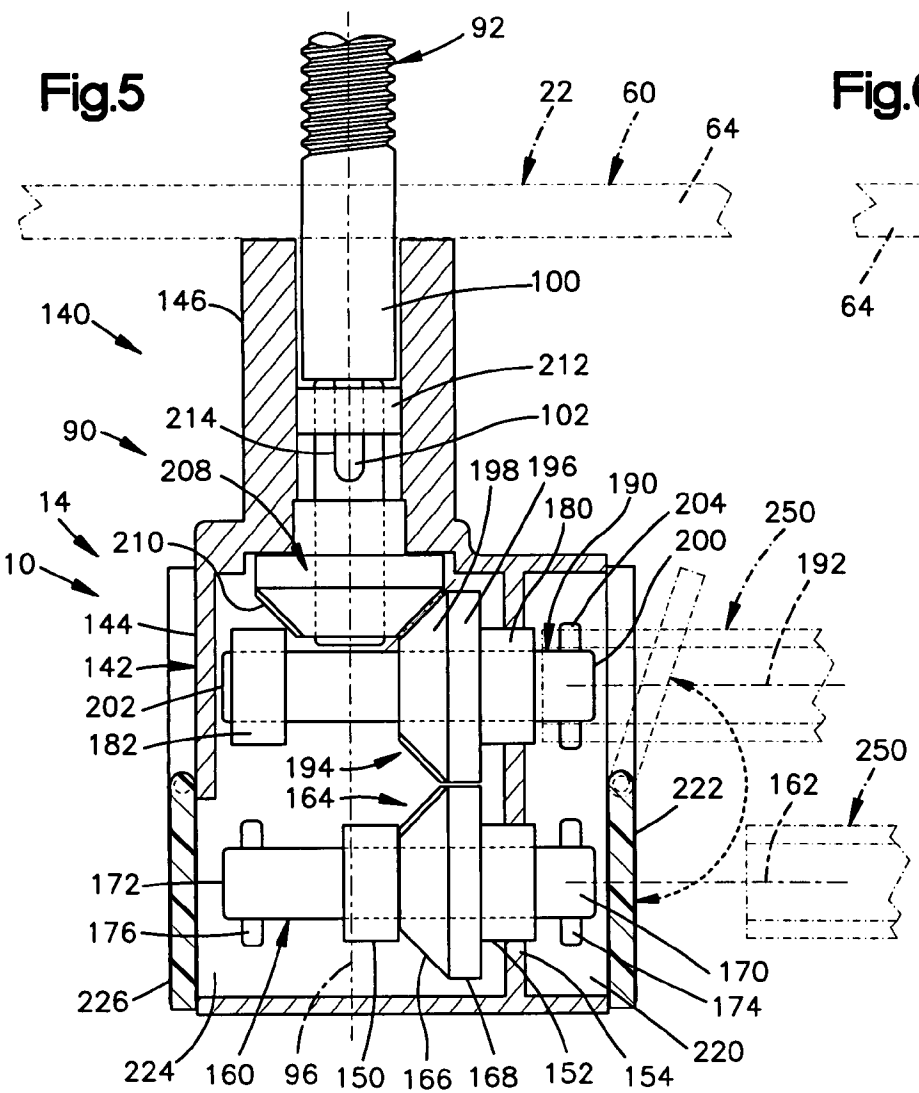
FIG. 5 is a sectional view of one embodiment of a gearbox that forms part of the bed end of FIG. 2.

The first drive tube section 252, which is coupled for rotation with the upper input shaft 190 of the gearbox 140 of the head end 14, causes the upper input shaft to rotate in the first direction of rotation, for example, clockwise as viewed in FIG. 6 as indicated by the arrow 253. The rotation of the upper input shaft 190 is transmitted through the upper bevel gear 198 (FIG. 5) into the output shaft 208 and thence into the lead screw 92 of the head end 14 of the bed 10.

The lead screw 92 rotates about the drive axis 96. The rotation of the lead screw 92 constitutes rotation relative to the slip nut 110. Because the lead screw 92 and the slip nut 110 are threadedly engaged, this relative rotation produces relative axial movement between the lead screw and the slip nut.

The relative axial movement between the lead screw 92 and the slip nut 110 is produced because the slip nut does not rotate on the lead screw. The slip nut 110 does not rotate because of the pressure plates 124 of the nut assembly 104. Specifically, the pressure plates 124 are mounted non-rotatably about the axis 96 in the nut housing 106. The radially inwardly directed force exerted by the pressure plate springs 128, urging the pressure plates 124 against the slip nut halves 112 and 114, is normally strong enough so that the abutting engagement of the pressure plates and the slip nut halves couples the slip nut to the pressure plates and thus prevents the slip nut from rotating on the lead screw 92. When the lead screw 92 is driven to rotate about its axis 96, therefore, the rotational force transmitted from the lead screw to the slip nut is not great enough to overcome this holding force exerted by the pressure plates 124 on the slip nut, and the slip nut does not rotate with the lead screw. Instead, the slip nut 110 translates along the screw 92 (or vice versa), producing relative axial movement between the nut housing 106 and the screw.

The relative axial movement that results is movement of the lead screw 92 and not the nut 110, for the following reasons. The slip nut 110 is mounted in the nut housing 106, which is fixed to the cross-beam 28 of the fixed portion 20 of the head end 14 of the bed 10. The fixed portion 20 of the bed 10 rests on the floor 12, supporting the movable portion 22 of the head end 14 off the floor. As a result, force tending to produce relative axial movement between the slip nut housing 104 and the lead screw 92 tends to cause the movable portion 22 of the head end 14, including the lead screw 92, to move axially in space relative to the floor 12 as it rotates about the drive axis.

Because the lead screw 92 is fixed in position vertically on the frame 60, the vertical movement of the lead screw 92 drives the entire movable portion 22 of the head end 14 vertically upward, relative to the fixed portion 20 of the head end. The frame 60 of the head end 14, and the gearbox 140, move vertically with the lead screw 96 relative to the floor 12.

The structure of the fixed portion 20 of the head end 14 is advantageous as follows. Axially directed force from the slip nut housing 106 is transmitted directly into the rigid cross-beam 28, to which the slip nut housing is fixed. This force is transmitted directly into the inner legs 24 and 26, to which the cross-beam 28 is rigidly fixed. As a result, no cables or pulleys, such as those shown in the aforementioned U.S. Pat. No. 5,134,731, are needed in the head end 14 of the bed 10.

The slip nut assembly 104 is operative to limit upward and downward travel of the movable portion 22 of the head end 14 of the bed 10, in a manner similar to that described in U.S. Pat. No. 5,134,731 discussed above. Specifically, when the lead screw 92 reaches its end of downward travel relative to the slip nut 110, the radially extending pin 98 (FIG. 3) on the rotating screw contacts the axially projecting pin 116 on the slip nut 110. This engagement couples the slip nut 110 for rotation with the lead screw 92, overcoming the holding force of pressure plates 124. As the slip nut 110 rotates thereafter, it rotates within the pressure plates 124 and thus within the slip nut housing 104. Because the slip nut 110 is rotating with the lead screw 92, it is no longer translating along the lead screw, and the slip nut no longer transmits axial force from the lead screw to the nut housing 106. This eliminates further relative vertical movement between the lead screw 92 and the slip nut 110, and the movable portion 22 of the head end 14 ceases vertical movement relative to the fixed portion 20 of the head end.

The above-described construction of the slip nut 100 is advantageous as follows. Because the slip nut 100 can be cast or molded, no costly machining process is needed. In addition, the axially projecting pins 116 and 118 can be formed as one piece with the remainder of the slip nut 110, simplifying the manufacturing process. Because the two slip nut halves 112 and 114 are identical, only one mold is needed. Also, when the slip nut 110 rotates at its end of travel as described above, the parting line between the two slip nut halves 112 and 114 makes an audible clicking noise that can signal the user of the bed of the end of travel condition.

Figure 7:
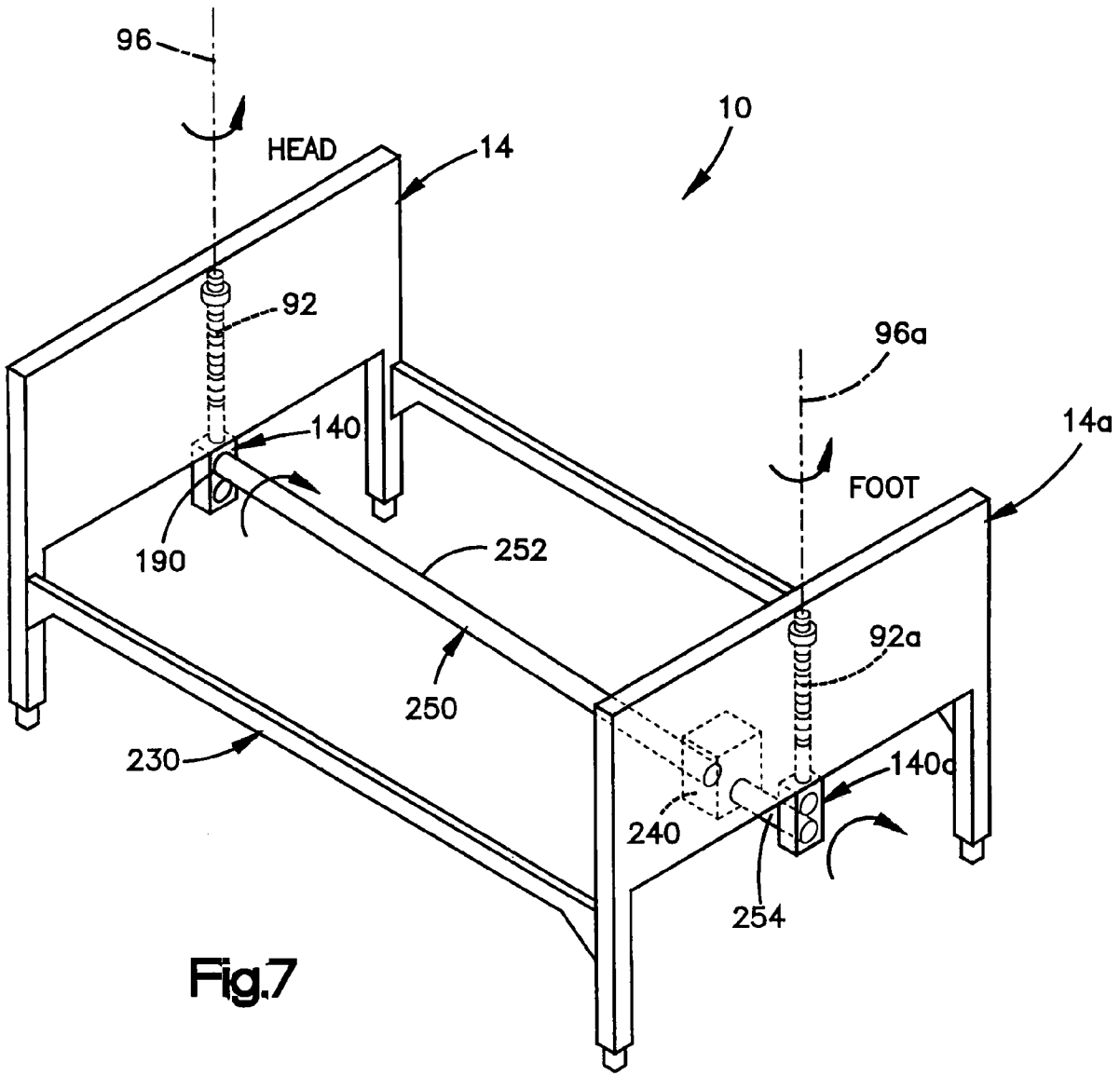
FIG. 7 is a schematic perspective view of the bed of FIG. 1.

At the same time that the first drive tube section 252 is driving the lead screw 92 of the head end 14 to move the head end upward, the second drive tube section 254 is driving the lead screw 92*a* of the foot end 14*a* of the bed 10 to move the foot end upward. FIG. 7 is a schematic perspective view of parts of the bed 10 that illustrates the directions of movement of the parts. The second drive tube section 254 is coupled (not shown) to the lower input shaft 160*a* of the gearbox 140*a* of the foot end 14*a*. Upon actuation of the motor 240 to raise the head end 14 of the bed 10 as described above, the second drive tube section 254 rotates in the same first direction of rotation in space relative to the head end 14 and the foot end 14*a* of the bed.

The rotation of the second drive tube section 254 causes the lower input shaft 160*a* of the foot end 14 to rotate in the first direction of rotation, which is counter-clockwise if looking at the great box 140*a* as viewed in FIG. 6 because the foot end 14*a* faces the opposite direction from the head end 14. This rotation of the lower input shaft 160*a* is transmitted through the bevel gears 164*a* and 194*a* into the upper input shaft 190*a*, causing the upper input shaft 190*a* to rotate in the opposite direction, that is, a clockwise direction as viewed in FIG. 6. This rotation of the upper input shaft 190*a* is transmitted into the output shaft 208*a* and thence into the lead screw 92*a* of the foot end 14*a* of the bed 10.

The lead screw 92*a* of the foot end 14*a* of the bed 10 rotates about its drive axis 96*a* within the foot end of the bed. This screw rotation within the foot end 14*a* is in the same direction in space as the direction of rotation of the lead screw 92 within the head end 14 of the bed 10. As a result, the rotation of the lead screw 92*a* of the foot end 14*a* causes the movable portion 22*a* of the foot end of the bed 10 to move vertically relative to the floor 12 in the same direction as the head end 14 is moving.

Thus, both ends 14 and 14*a* of the bed 10 move vertically in the same direction—upward or downward as viewed in FIGS. 6 and 7—because the drive tube assembly 250 is connected with different input points in the two gearboxes 140 and 140*a*. This simultaneous movement occurs even though the first drive tube section 252 and the second drive tube section 254 are rotating in the same direction relative to the other parts of the assembled bed 10. This result is achieved in the bed 10 by coupling the second drive tube section 254 with the lower input shaft 160*a* of the gearbox 140*a* of the foot end 14*a* whenever the first drive tube section 252 is coupled with the upper input shaft 190 of the gearbox 140 of the head end 14 of the bed 10 (or vice versa).

When the movable portion 22 of the head end 14 of the bed 10 and the movable portion 22*a* of the foot end 14*a* of the bed move vertically, the bed spring assembly 230 moves vertically also, relative to the floor 12, as desired. This has the effect of raising or lowering a patient who is lying on the bed spring assembly 230.

It can thus be seen that, in the bed 10 illustrated in FIGS. 1-7, the bed end 14 is interchangeable with the bed end 14*a*, thus making the bed ends "universal". As a result, when parts of a bed 10 are selected from a warehouse for delivery to a home customer, any two bed ends 14 can be selected; there is no need to pick a "head end" and a distinct "foot end". This can eliminate trips back to the warehouse if an incorrect selection is made and discovered at the time of setting up the bed 10 in the home. In addition, this "universal" quality of the bed end 14 can make it unnecessary to manufacture two different bed ends for use in the bed 10.

Figure 8:
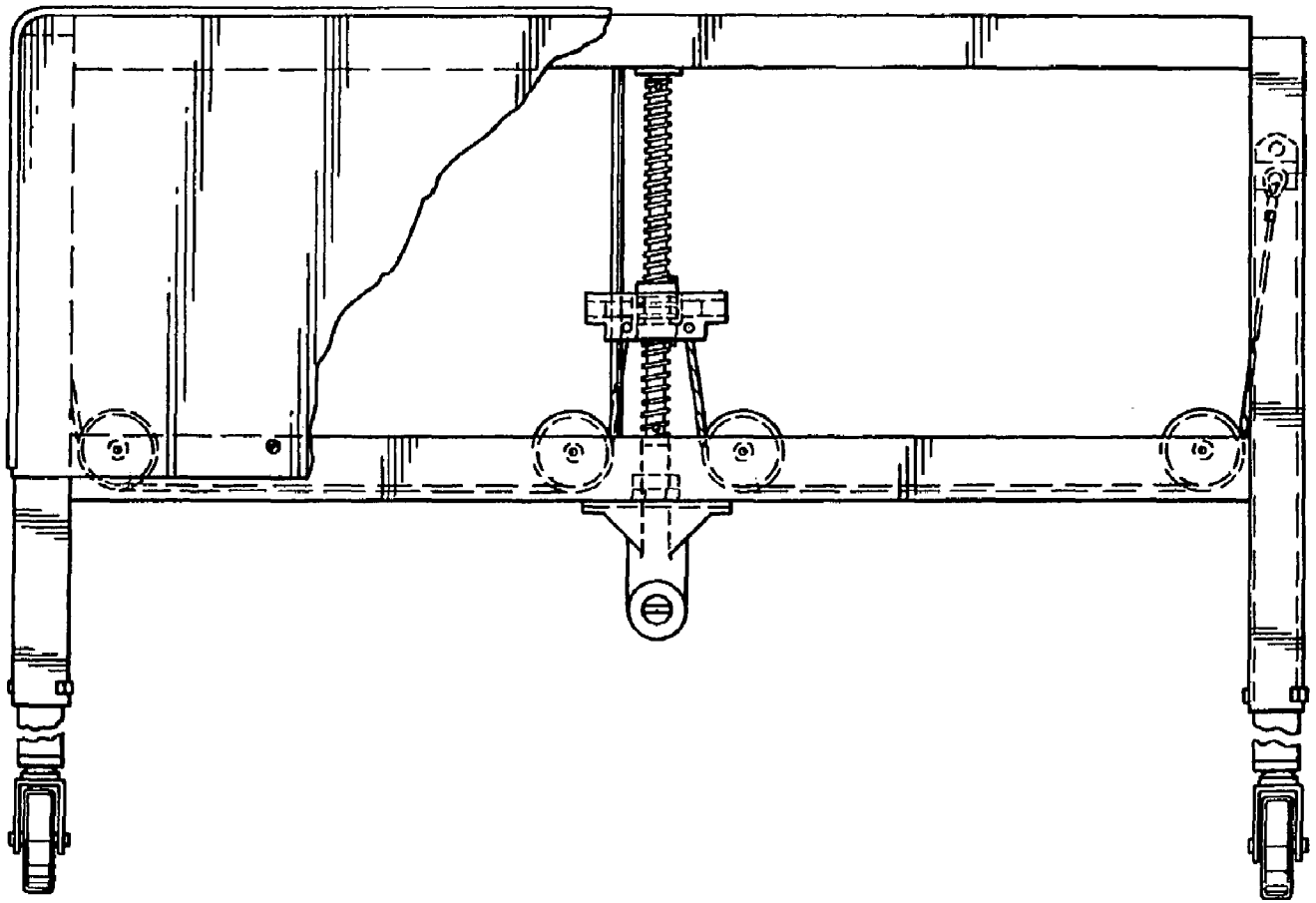
Fig.8 Prior Art
FIG. 8 is a view of a prior art bed end.

The bed end 10 described above incorporates an elevating mechanism including the cross-beam 28 that is rigidly tied between the inner legs 24 and 26. The cross-beam 28 receives force from the lead screw 92 via the slip nut 110 and the slip nut housing 104, and transmits that force to the inner legs 24 and 26. It should be understood that other types of elevating mechanisms could be used. For example, FIG. 8 illustrates a prior art bed end shown in U.S. Pat. No. 5,134,731. The bed end shown in FIG. 8 includes an elevating mechanism that uses pulleys and cables to transmit force between the slip nut housing and the inner legs of the bed end. This is one type of alternative elevating mechanism that is usable in a universal bed end 14 as described above.

Figure 10:
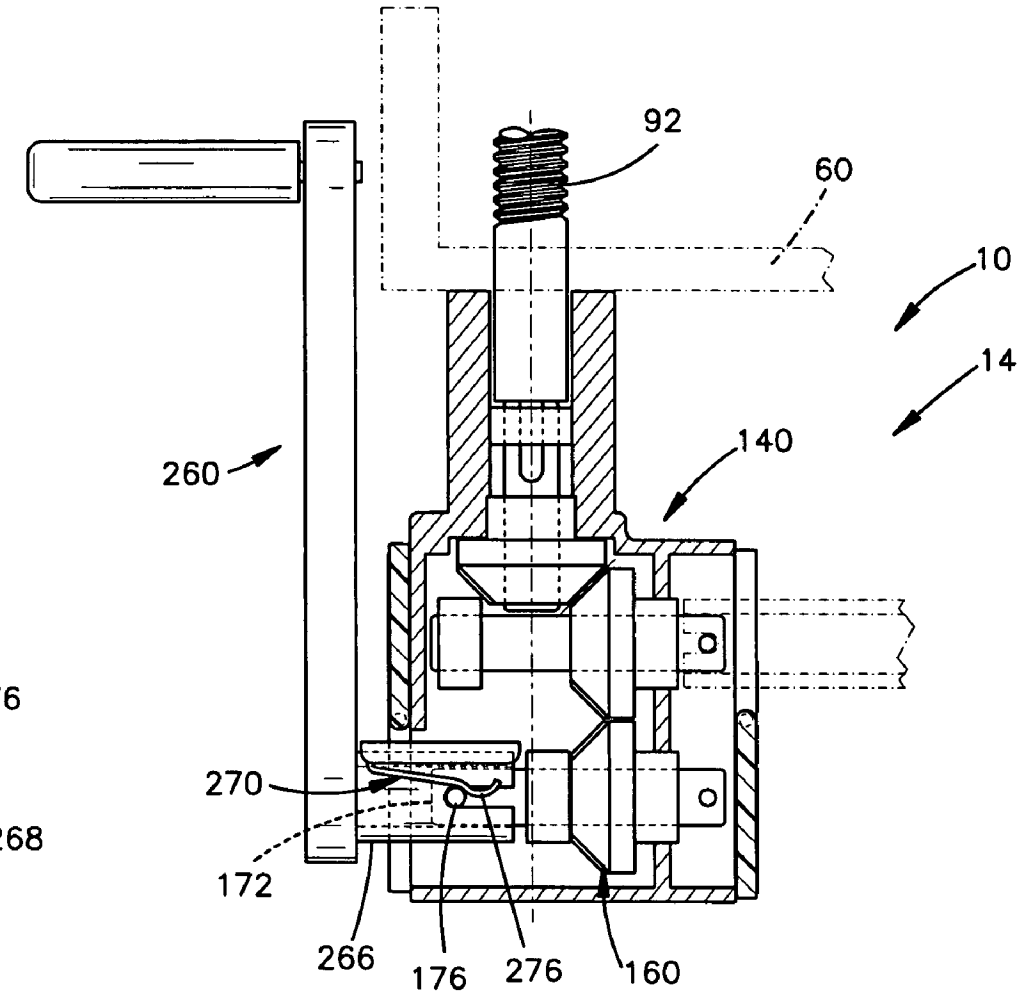
FIG. 10 is a view similar to FIG. 5 showing the crank of FIG. 9 attached to a gearbox.
Figure 9:
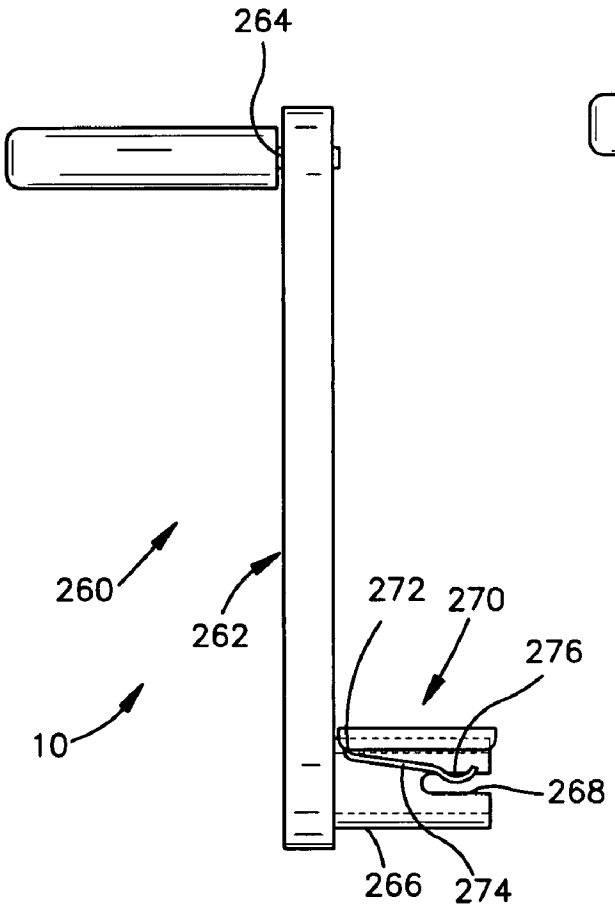
FIG. 9 is an elevational view of one embodiment of a crank that is usable with the bed end of FIG. 2.

FIGS. 9 and 10 illustrate a gearbox hi/lo crank 260 for use in the head end 14 of the bed 10. Prior art home articulating bed designs that are semi electric beds (manual hi/lo) have a die cast primary crank with a folding handle. The crank is permanently fixed to the gearbox. Because the crank has to be located at the foot end of the bed (projecting out into the room from the outer major side surface of the foot end), then by default the bed end that has the crank must be used as the foot end; the head end and the foot end are not interchangeable.

Some beds also include an emergency crank that is a simple wire-form crank for emergency use only. This has one end adapted to engage the articulation motors and the other end adapted to engage the hi/lo gearbox. By virtue of its light weight construction this crank is not suitable for extended use.

The crank 260 (FIGS. 9 and 10) of the present invention includes a two-part handle 262 that is hinged at 264 to reduce its size when installed. A slotted tube 266 projects from the handle 262. The tube 266 has a cylindrical configuration adapted to fit over the second end portion 172 of the lower input shaft 160 of the gearbox 140 when the door 276 is pivoted upward, as shown in FIG. 10. A pair of diametrically opposed slots 268 in the tube 266 fit over the drive pins 176 on the second end portion 172 of the lower input shaft 160. The tube 266 is made from steel and is strong enough together with the other parts of the crank 260 to raise or lower the bed 10 repeatedly over the lifetime of the bed end 14 without deformation.

The crank 260 also includes a detent member 270. In the illustrated embodiment, the detent member 270 is a U-shaped wire spring having a base portion 272 crimped onto the tube 266. Two resilient leg portions 274 of the wire spring 270 project from the base portion 272. Each one of the leg portions 274 has a bent end portion 276 adapted to engage (fit behind) one of the drive pins 176 on the lower input shaft 160.

To assemble the crank 260 to the gearbox 140, the user places the tube 266 of the crank over the second end portion 172 of the lower input shaft 160. The slots 268 in the tube 266 are fitted over the drive pins 176. As the tube 266 is slid axially over the input shaft 160, the bent end portions 276 of the legs 274 of the wire spring 270 engage the drive pins 176 and are cammed away from the drive pins to allow the tube to slide fully onto the input shaft.

When the drive pins 176 reach the ends of the slots 268, the wire spring legs 274 resiliently move back into their starting position. In this position, the drive pins 176 engage the bent end portions 276 of the wire spring legs 274. This engagement resists removal of the tube 266 from the input shaft 160, without a strong pull. Thus, the crank 260 is fixedly but not permanently attached to the gearbox 140 and may be used with the gearbox for so long as the bed 10 is assembled in that location. When the bed 10 is to be disassembled, the crank 260 can be removed by the dealer.

The crank 260 is strong enough to be used as an everyday crank for hi/lo purposes, or for emergency (power failure) operations. Nevertheless, the crank 260 is removable from the input shaft 160 by the dealer so that it can be placed on either bed end 14 or 14*a* during assembly of the bed 10. Because the crank 260 is removable from the bed end 14 and usable on another bed end 14, this helps to make the bed ends 14 and 14*a* universal—that is, interchangeable at either end of the bed 10, in comparison to a bed end having a permanently affixed crank.

Figure 11:
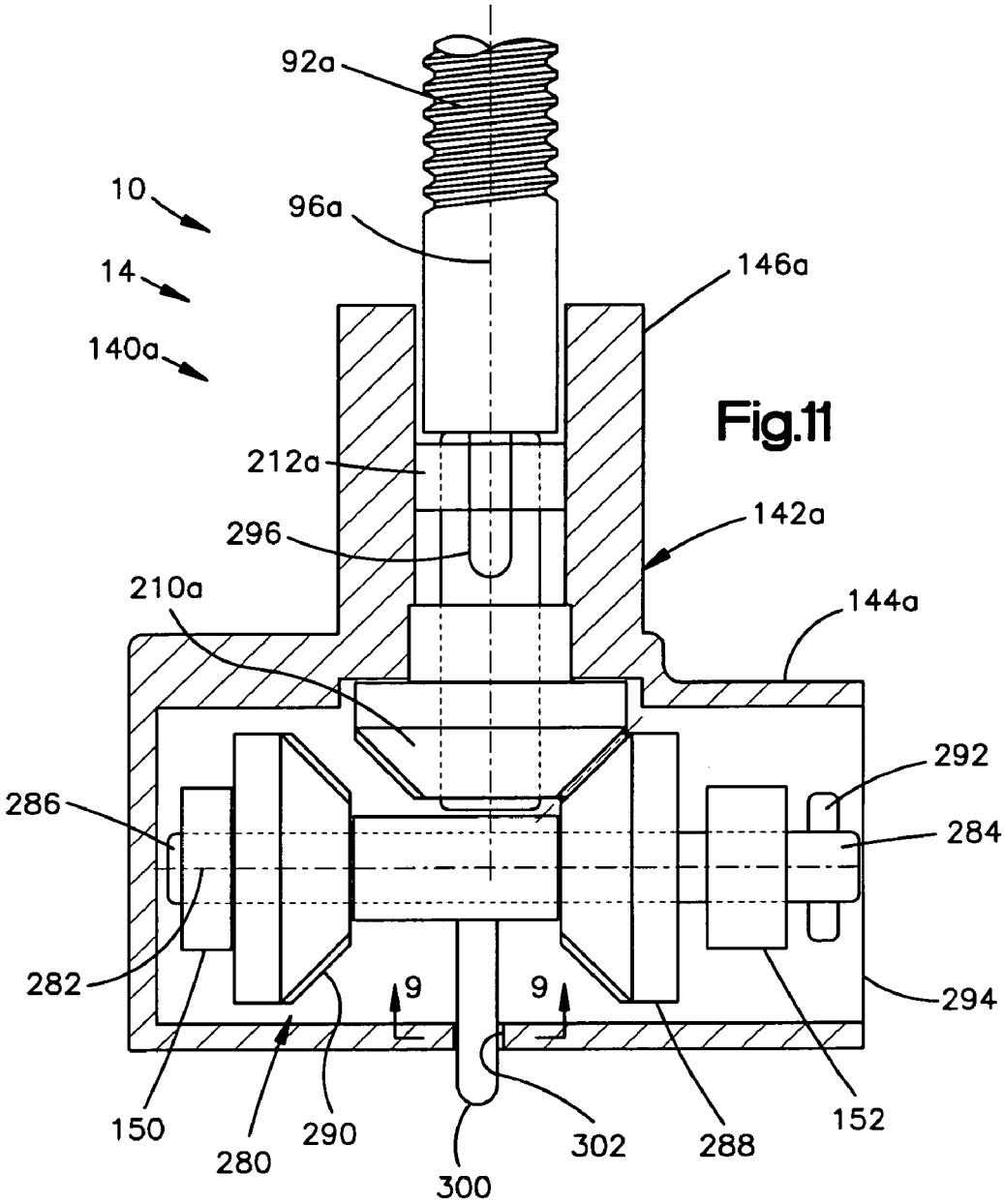
FIG. 11 is a sectional view of an alternative gearbox embodiment that can be part of the bed end of FIG. 2.
Figure 12:
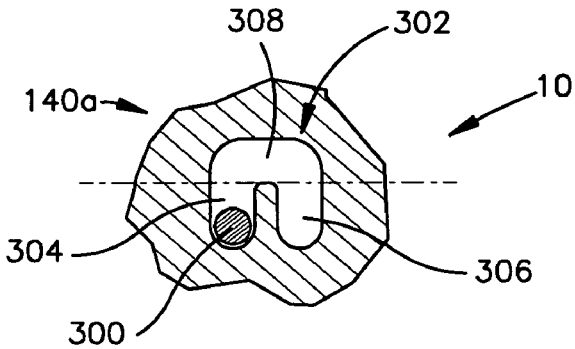
FIG. 12 is a sectional view of a portion of the gearbox of FIG. 11.

FIGS. 11 and 12 illustrate an alternative gearbox 140*a* for use in the head end 14 or foot end 14*a* of the bed 10. The gearbox 140*a* is similar to the gearbox 140 (FIGS. 1-6), and parts that are the same or similar are given the same reference numerals with the suffix "a" added.

The gearbox 140*a* includes a housing 142*a*. The housing 142*a* has a main body portion 144*a* and an outlet portion 146*a* that projects upward from the main body portion. The gearbox 140*a* is mounted on the frame, in a manner not shown, so that the drive axis 96*a* extends vertically into the outlet portion 146*a* of the housing 142*a*.

Two bushings 150*a* and 152*a* in the main body portion 144*a* of the housing 142*a* support a single input shaft 280 for rotation relative to the housing. The input shaft 280 is rotatable about an axis 282 that is perpendicular to the drive axis 96*a*.

The input shaft 280 has first and second opposite end portions 284 and 286. A first gear assembly 288 is fixed on the input shaft 280 for rotation with the input shaft, adjacent the first end portion 284 of the input shaft. A second gear assembly 290 is fixed on the input shaft 280 for rotation with the input shaft, adjacent the second end portion 286 of the input shaft. The second gear assembly 290 is spaced apart from the first gear assembly 288.

A pair of drive pins 292 project radially from the input shaft 280 at diametrically opposite locations on the first end portion 284. The drive pins 292 are fixed for rotation with the input shaft 280. The gearbox housing 142*a* has a single access opening 294 adjacent the first end portion 284 of the input shaft 280. The access opening 294 is not covered by a door.

The output portion 144*a* of the housing 140*a* supports an output bevel gear 210*a* that is located between the first and second gear assemblies 288 and 290 on the input shaft 280. The output bevel gear 210*a* is supported in the output portion 144*a* of the housing 140*a*, by one or more bushings 212*a*, for rotation about the drive axis 96*a*. The output bevel gear 210*a* has a mortise and tenon connection 296 to the lead screw 92*a*, as described above with reference to FIG. 5. As a result, the lead screw 92*a* is fixed for rotation with the output bevel gear 210*a* about the drive axis 96*a*.

The input shaft 280 is supported by the bushings 150*a* and 152*a*, for sliding movement relative to the housing 142*a* in a direction parallel to the axis of rotation 282 of the drive shaft. The input shaft 280 includes a locator pin 300 (FIGS. 11 and 12) that projects radially from a location between the first and second gear assemblies 288 and 290. The locator pin 300 is received in a U-shaped slot 302 in the housing. The slot 302 has first and second end portions 304 and 306 and a central portion 308.

When the locator pin 300 is in the first end portion 304 of the slot 302, as shown in FIGS. 11 and 12, the first gear assembly 288 on the input shaft 280 is in meshing engagement with the output bevel gear 210*a*. As a result, rotation of the input shaft 280 in a first direction about the axis 282 results in rotation of the output bevel gear 210*a*, and the lead screw 92*a*, in a first direction of rotation about the drive axis 96*a*.

When the locator pin 300 is in the second end portion 306 of the slot 302, the input shaft 280 is moved axially from the position shown in FIG. 11, and the second gear assembly 290 on the input shaft is in meshing engagement with the output bevel gear 210*a*. Therefore, rotation of the input shaft 280 in the first direction about the axis 282 results in rotation of the output bevel gear 210*a*, and the lead screw 92*a*, in a second or opposite direction of rotation about the drive axis 96*a*.

As a result, the bed end 14 to which the gearbox 140*a* is attached can be used at either end of the bed 10, and still provides simultaneous upward or downward movement of both bed ends, simply by moving the input shaft 280 from one position to the other. Therefore, a bed 10, having two identical bed ends 14 with gearboxes 140*a* of the type shown in FIGS. 11 and 12, can use the two bed ends interchangeably simply by adjusting the gearbox as described above.

Figure 13:
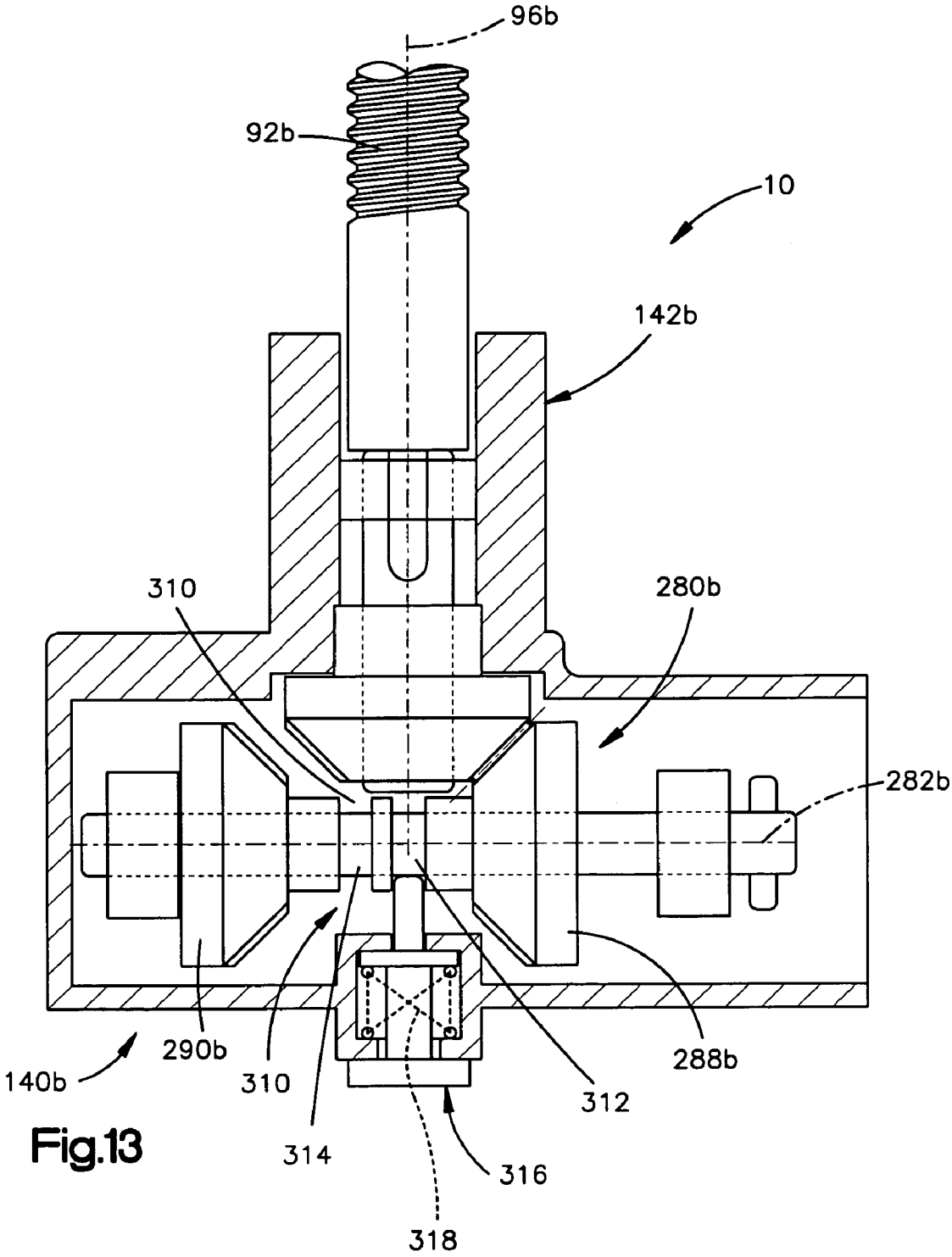
FIG. 13 is a sectional view of another alternative gearbox embodiment that can be part of the bed end of FIG. 2.
Figure 14:
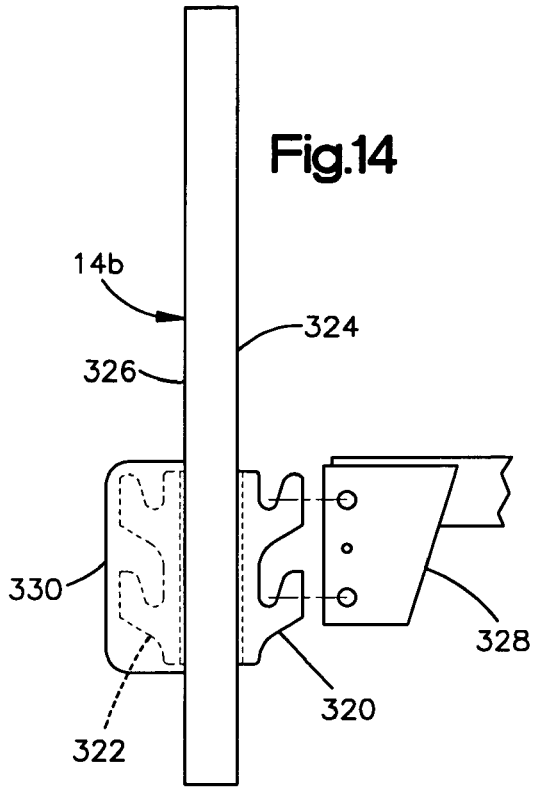
FIGS. 14-17 are views of alternative corner plates one embodiment of that can be used with the bed end of FIG. 2.

FIG. 13 illustrates another alternative gearbox 140*b* for use in the head end or foot end of the bed 10. The gearbox 140*b* is similar in construction and operation to the gearbox 140*a* (FIGS. 11 and 12). Parts of the gearbox 140*b* that are the sane as or similar to corresponding parts of the gearbox 140*a* are given the same reference numerals with the suffix "b" attached.

The gearbox 140*b* (FIG. 13) includes an input shaft 280*b* that is supported for sliding movement relative to the housing 142*b* in a direction parallel to the axis of rotation of the input shaft. Disposed between the two gear assemblies 288*b* and 290*b* on the input shaft 280*b* is a control portion 310 of the input shaft. The control portion 310 includes two circumferential grooves 312 and 314 spaced axially from each other. The gearbox 310 also includes a locator pin 316. The locator pin 316 is supported on the housing 142*b* for in-and-out (radial) sliding movement relative to the housing and to the input shaft 280*b*.

When the locator pin 316 is in the first groove 312 on the input shaft 280*b*, as shown in FIG. 13, the first gear assembly 288*b* on the input shaft 280*b* is in meshing engagement with the output bevel gear 210*b*. As a result, rotation of the input shaft 280*b* in a first direction about the axis 282*b* results in rotation of the output bevel gear 210*b*, and the lead screw 92*b*, in a first direction of rotation about the drive axis 96*b*.

The locator pin 316 can be pulled out of the first groove 312 against the bias of a spring 318 to enable the input shaft 280*b* to be moved axially until the second groove 314 is located radially inward of the locator pin. The locator pin 316 can then be released and the spring 318 will hold it in the second groove 314. In this position, the second gear assembly 290*b* on the input shaft 280*b* is in meshing engagement with the output bevel gear 210*b*. Therefore, rotation of the input shaft 280*b* in the first direction about the axis 282*b* results in rotation of the output bevel gear 210*b*, and the lead screw 92*b*, in a second or opposite direction of rotation about the drive axis 96*b*.

As a result, the bed end 14 to which the gearbox 140*b* is attached can be used at either end of the bed 10, and still provide simultaneous upward or downward movement at both bed ends 14 and 14*a*, simply by moving the input shaft 280*b* axially from one position to the other. Therefore, a bed 10, having two identical bed ends with gearboxes 140*b* of the type shown in FIG. 13, can use the two bed ends interchangeably simply by adjusting the gearbox as described above.

FIGS. 14-17 illustrate some alternative corner plate (bracket) designs for use in the head end 14 or foot end 14*a* of the bed 10. The corner plates shown in FIGS. 14-17 can be used with other bed ends, and, specifically, with other bed ends that do not have one of the gearbox designs 140, 140*a* or 140*b*, or the elevating mechanism described above. The corner plates are designed to enable a bed end to which the corner plates are attached, to be reversed front to back and still function to support a spring assembly of the bed. This feature makes the bed ends more easily used at either end of the bed 10.

The corner plates are shown with bed ends 14*b*, 14*c*, and 14*d* that are similar in construction and operation to the bed end 14. The bed end 14*b* (FIG. 14) includes first and second corner plates 320 and 322 that are mirror images of each other and that extend from first and second opposite major side surfaces 324 and 326 of the bed end 14*b*.

When the bed end 14*b* is assembled in a bed 10 so that the first corner plate 320 is to be used (for example with a frame rail or a spring assembly shown partially at 328), the first corner plate 320 is uncovered. A wall protector 330 is placed over the unused second corner plate 322. As a result, the first corner plate 320 is available for use, and the second corner plate 322 is protected and covered to prevent contact with the wall if the bed end 14*b* is placed with the second corner plate facing the wall.

When the bed end 14*b* is assembled in a bed 10 so that the second corner plate 322 is to be used, the second corner plate is uncovered (not shown). The wall protector 330 is placed over the unused first corner plate 320. As a result, the second corner plate 322 is available for use, and the first corner plate 320 is protected from contact with the wall.

In this manner, the bed end 14*b* can be assembled in a bed 10 so that either the first major side surface 324 or the second major side surface 326 of the bed end faces the other parts of the assembled bed 10, and a corner plate 320 and 322 will be available to support the spring assembly or frame rails 328 of the bed.

The bed end 14*c* (FIG. 15) includes a corner plate assembly 332 including first and second corner plates 334 and 336 that are mirror images of each other and that are extendible from first and second opposite major side surfaces 338 and 340 of the bed end. The corner plate assembly 332 includes a central portion 342 that is fixed by rivets 356, or in another manner, to a side surface 348 of the bed end 14*c*.

The first corner plate 334 is hinged to the central portion 342. The first corner plate 334 is pivotally movable between a first position in which it projects from the first major side surface 38 of the bed end 14*c* as shown in FIG. 15, and a second position (not shown) in which the first corner plate lies flat against the first major side surface.

The second corner plate 336 is also hinged to the central portion 342. The second corner plate 336 is pivotally movable between a first position in which it projects from the second major side surface 340 of the bed end 14*c* as shown in FIG. 15, and a second position (not shown) in which the second corner plate lies flat against the second major side surface.

Figure 15:
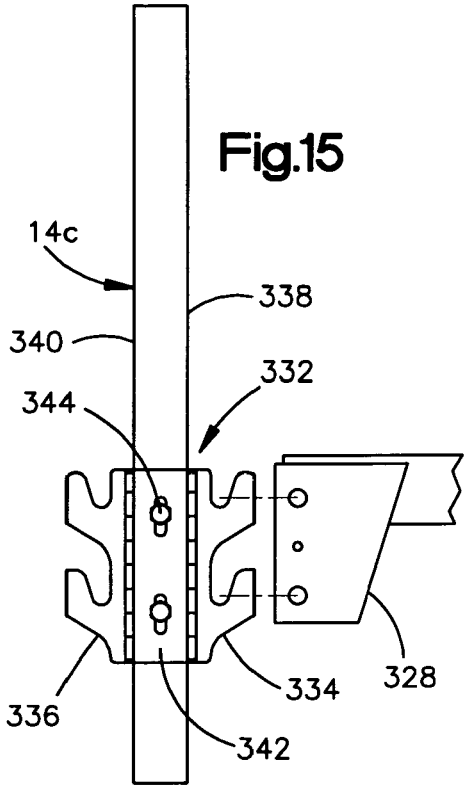

When the bed end 14*c* is to be assembled in a bed 10 with the first major side surface 338 facing the opposite end of the bed, the first corner plate 334 is swung into the operative position shown in FIG. 15. The frame rail or spring assembly shown partially at 328 is attached to the first corner plate 334. When this is done, the second corner plate 336 can be laid flat against the second major side surface 340 of the bed end 14*c*, out of the way.

When the bed end 14*c* is to be assembled in a bed 10 with the second major side surface 340 facing the opposite end of the bed, the second corner plate 336 is swung into the operative position shown in FIG. 15. A frame rail or spring assembly such as shown partially at 328 is attached to the second corner plate 336. When this is done, the first corner plate 334 can be laid flat against the first major side surface 338 of the bed end 14*c*, out of the way.

In this manner, the bed end 14*c* can be assembled in a bed 10 so that either the first major side surface 338 or the second major side surface 340 of the bed end faces the other parts of the assembled bed, and a corner plate 334 or 336 will be available to support the spring assembly or frame rails 328 of the bed.

The bed end 14*d* (FIG. 16) includes a single corner plate 350 that is movable between first and second opposite major side surfaces 352 and 354 of the bed end 14*d*. The bed end has two support pins 356 for supporting the corner plate 350. The support pins 356 project from the side 358 of the bed end 14*d*.

The bed end 14*d* also has a lock member indicated schematically at 360. The lock member 360 may be a pin, for example, that is movable vertically on the bed end 14*d* along a slot 362. The corner plate 350 has two notches 364 for receiving the support pins 356 on the bed end 14*d*.

Figure 16:
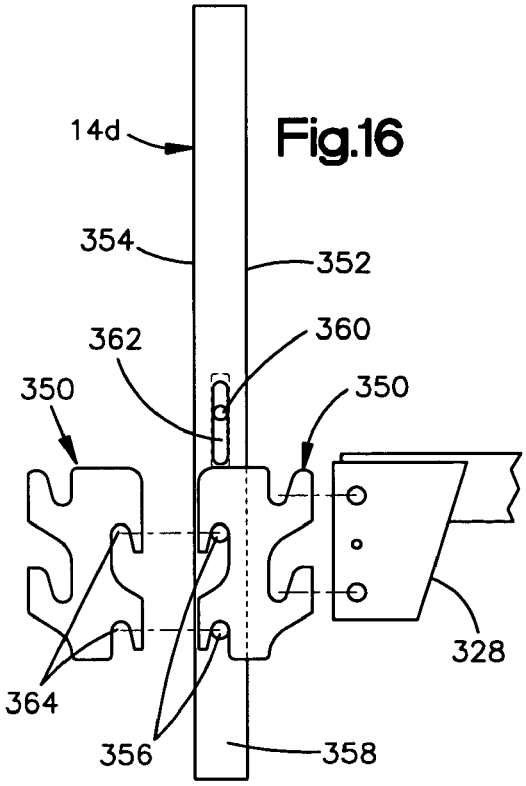

When the bed end 14*d* is assembled in a bed 10 so that the corner plate 350 is to be used projecting from the first major side surface 352 of the bed end (for example with a frame rail or a spring assembly shown partially at 328), the corner plate 350 is assembled as shown attached in FIG. 16 with the pins 356 received in the notches 364. The lock member 360 is moved into a locking position against the corner plate 350 to hold the corner plate in position on the bed end 14*d*.

When the bed end 14*d* is assembled in a bed 10 so that the corner plate 350 is to be used projecting from the second major side surface 354 of the bed end, the corner plate is removed and switched to the other side of the bed end, as shown to the left in FIG. 16. The corner plate 350 is hooked onto the support pins 356, and the locking mechanism 360 is used to hold the corner plate in that position on the bed end 14*d*.

In this manner, the bed end 14*d* can be assembled in a bed 10 so that either the first major side surface 352 or the second major side surface 354 of the bed end faces the other parts of the assembled bed, and a corner plate 350 will be available to support the spring assembly or frame rails 328 of the bed.

Figure 17:
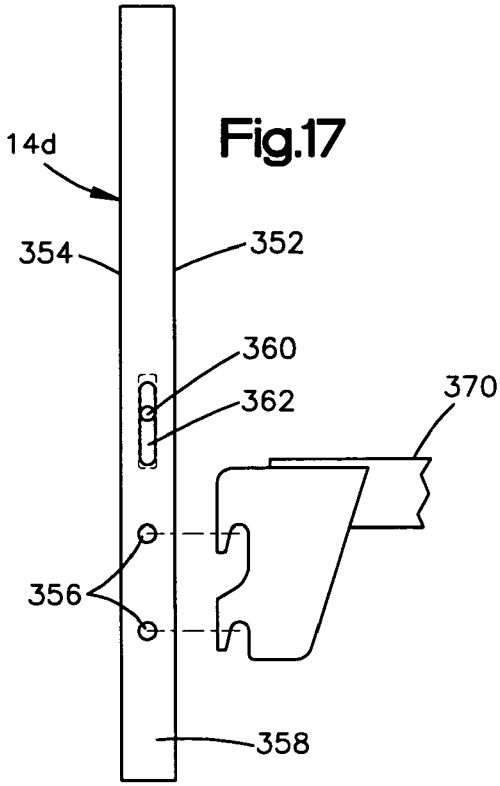

FIG. 17 illustrates the use of the bed end 14*d* with a spring assembly or frame rail 370 that has notches for receiving the support pins 356 on the bed end. In this case, a separate corner plate, such as the corner plate 350, is not needed. The support pins 356 function as the reversible corner plate. The spring assembly or frame rail 370 is supportable from either major side surface 352 or 354 of the bed end 14*d*.

The parts of the bed end 14 shown in FIGS. 1-6 are structural and operational parts for controlling at least one operational aspect of the bed, specifically, elevation of the bed. A bed end 14 in accordance with the present invention also includes a bed end cover for enclosing and covering the operational and structural parts. Several alternative covers are shown, in FIGS. 18-22.

The preferred material for these bed end covers is an engineered plastic. The selected material should be washable without being affected by water or solvents and without absorbing moisture. The selected material should also be scratch resistant, impact resistant, and ultraviolet resistant. Also, the material should be able to be molded or extruded with a single color throughout. Suitable materials include but are not limited to HDPE, ABS, and PVC.

The materials typically used for prior art decorative/covering panels in home care adjustable beds are paper or fiberboard covered in vinyl laminate. This material can scratch completely through the laminate, absorbs moisture when washed, does not have high impact resistance, and is not ultraviolet resistant. In addition, such a cover is manufactured by dropping the various panels of the cover into a fixture, then screwing or gluing them together. This is a time and labor-intensive operation.

An engineered plastic bed end cover is easier to handle, because it is impact and scratch resistant. It is also quicker to assemble in the plant. It is also washable when returned from home use to the dealer, for use by another patient, as is required. It is cost effective to manufacture, more durable, and stronger. In addition, the use of molded plastic for the bed end cover allows for color variations and therefore more artistic quality to the bed end, as well as different physical profiles or configurations for the bed end.

Figure 2:
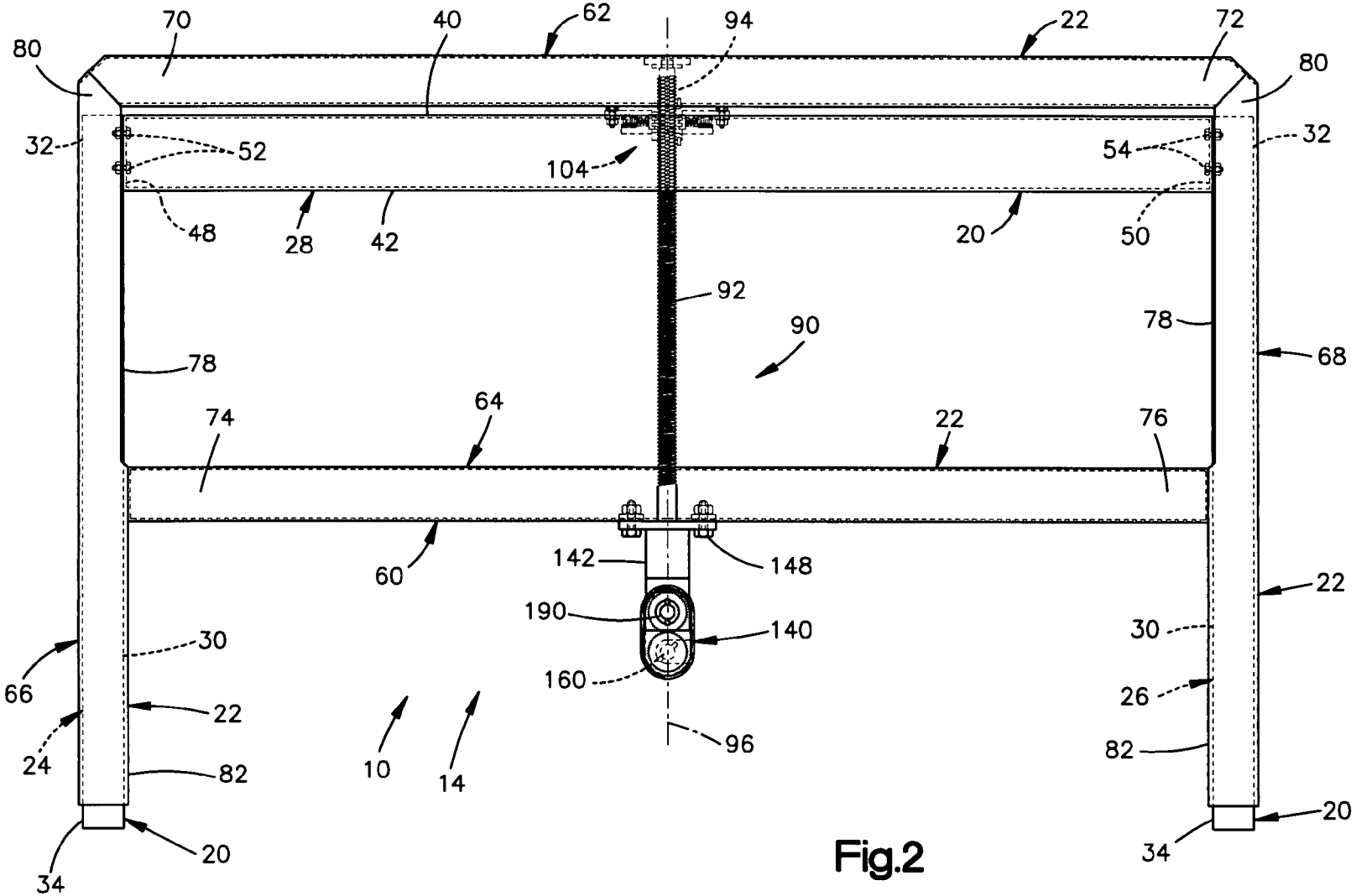
FIG. 2 is a schematic elevational view of one embodiment of a bed end that forms part of the bed of FIG. 1.

The cover 400 (FIGS. 18 and 19) is one example of a plastic bed end cover that is constructed in accordance with the present invention. The cover 400 is a hollow cover for enclosing and covering the operational and structural assembly shown in FIG. 2. This cover 400 is extremely easy to assemble to the structural and operational parts of the bed end 14 as shown in FIG. 2, for example. It is also easy to manufacture and handle.

The cover 400 is a one-piece plastic cover having an interior major side panel 402 that faces inward toward the opposite end of the bed 10 when assembled, and an opposite exterior major side panel 404. The cover 400 is preferably made by blow molding. A preferred material is HDPE (high density polyethylene).

The cover 400 also has an upper edge portion 406 interconnecting the interior and exterior major side panel, panels 402 and 404. First and second opposite side edge portions 408 and 410 of the cover 400 interconnect the interior and exterior major side panels 402 and 404 adjacent the first and second legs (shown in phantom in FIG. 18) of the bed end. The cover 400 further has a lower edge portion 412 extending between the first and second opposite side edge portions 408 and 410. The cover 400 has an open bottom edge 414 for enabling sliding movement of the hollow cover over the operational and structural assembly in a direction between the upper edge portion 406 and the lower edge portion 412 of the cover (as indicated by the arrow 416).

Figure 18:
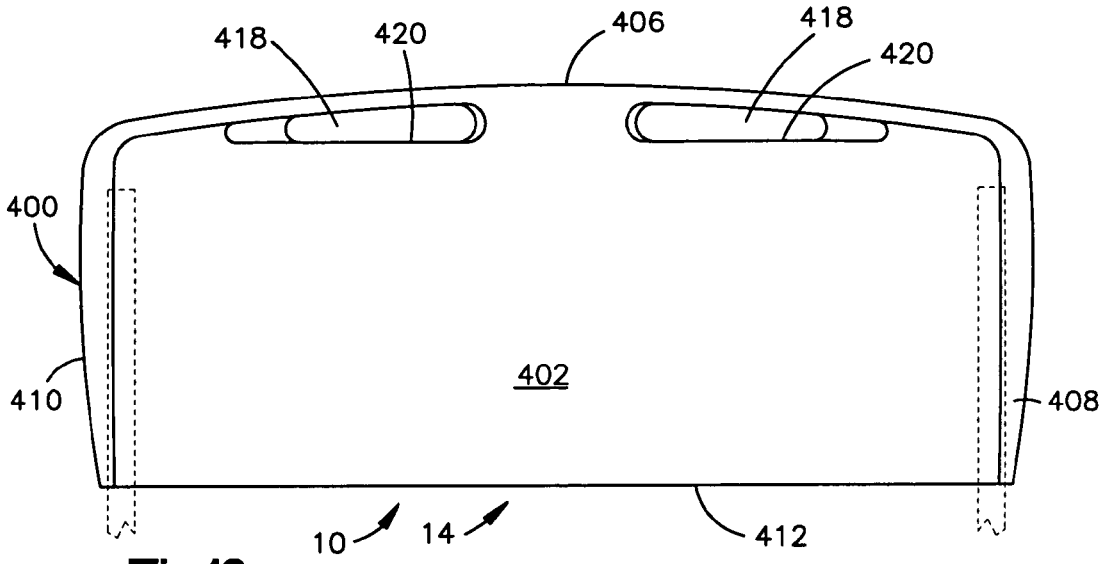
FIG. 18 is an elevational view of one embodiment of a plastic bed end cover in accordance with the present invention.
Figure 19:
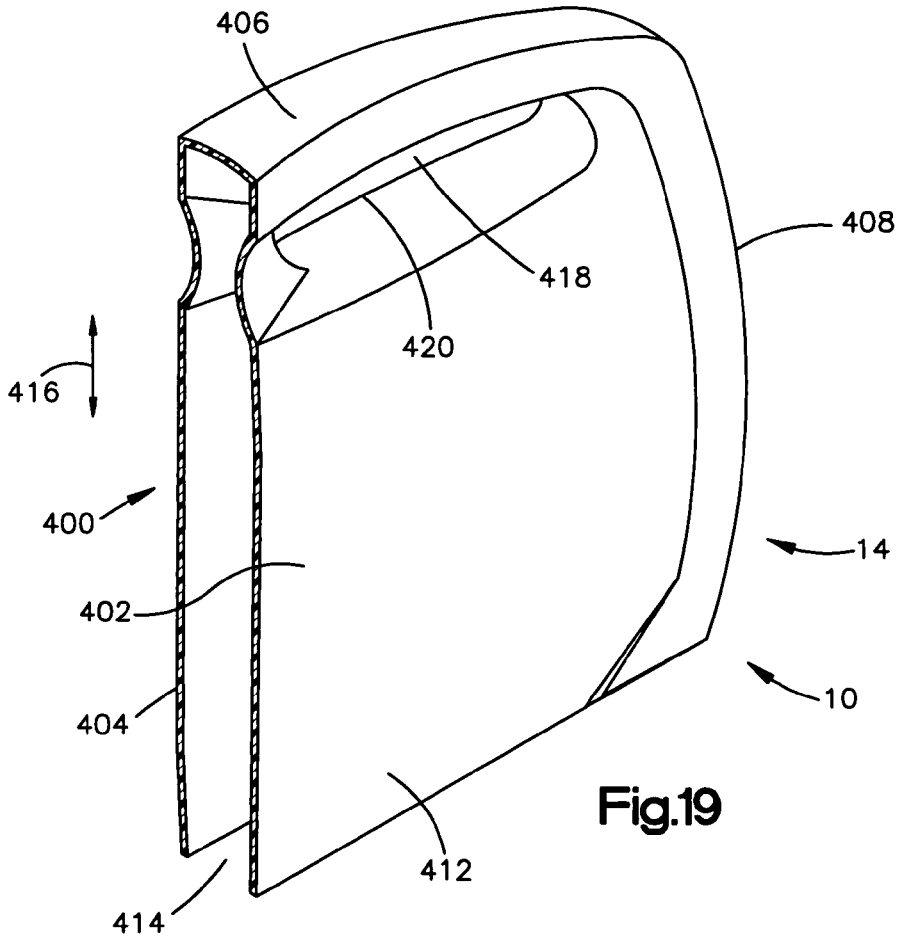
FIG. 19 is a cutaway sectional view of the bed end cover of FIG. 18.
Figure 20:
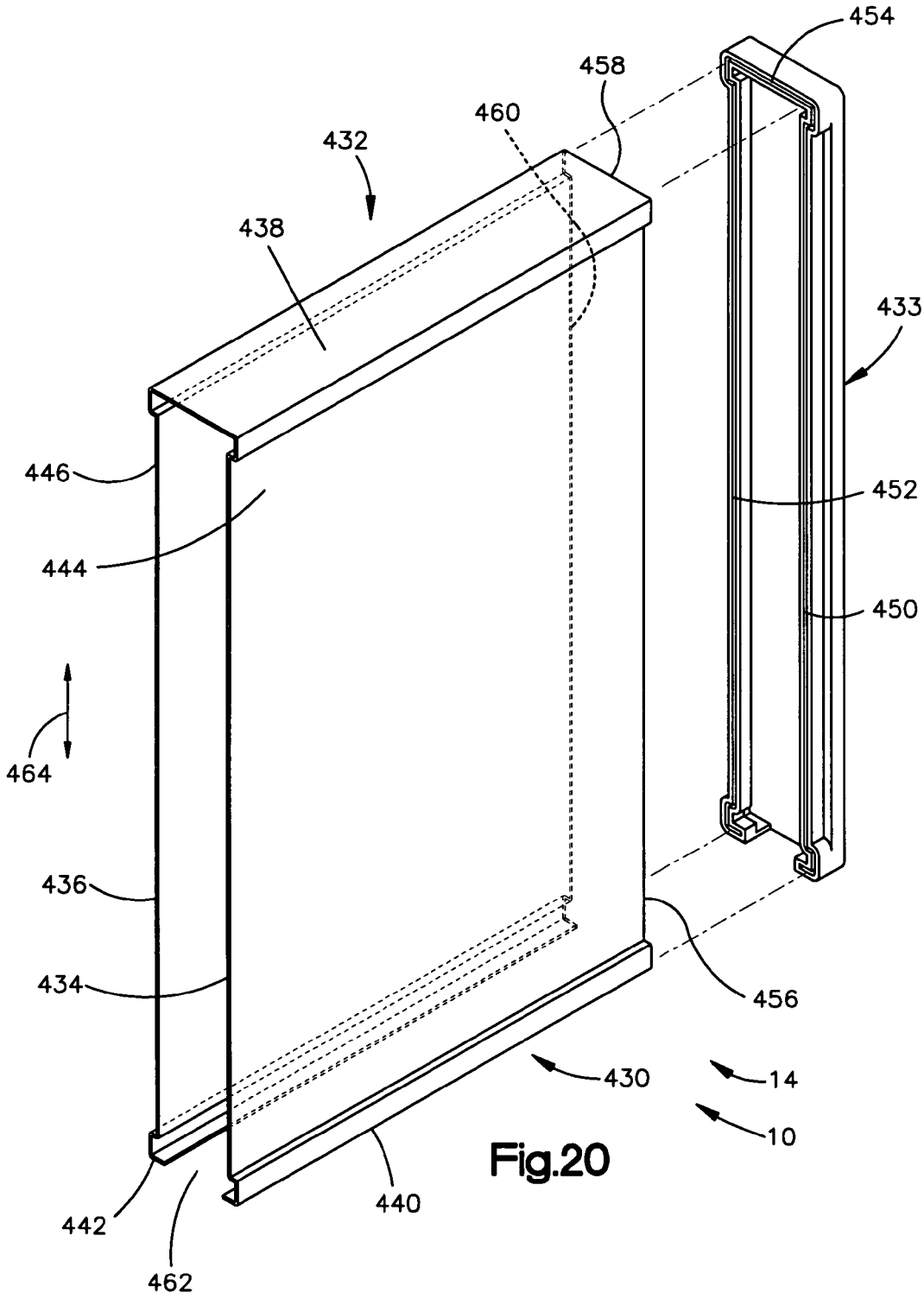
FIG. 20 is an exploded view of an alternative plastic bed end cover embodiment in accordance with the present invention.
Figure 21:
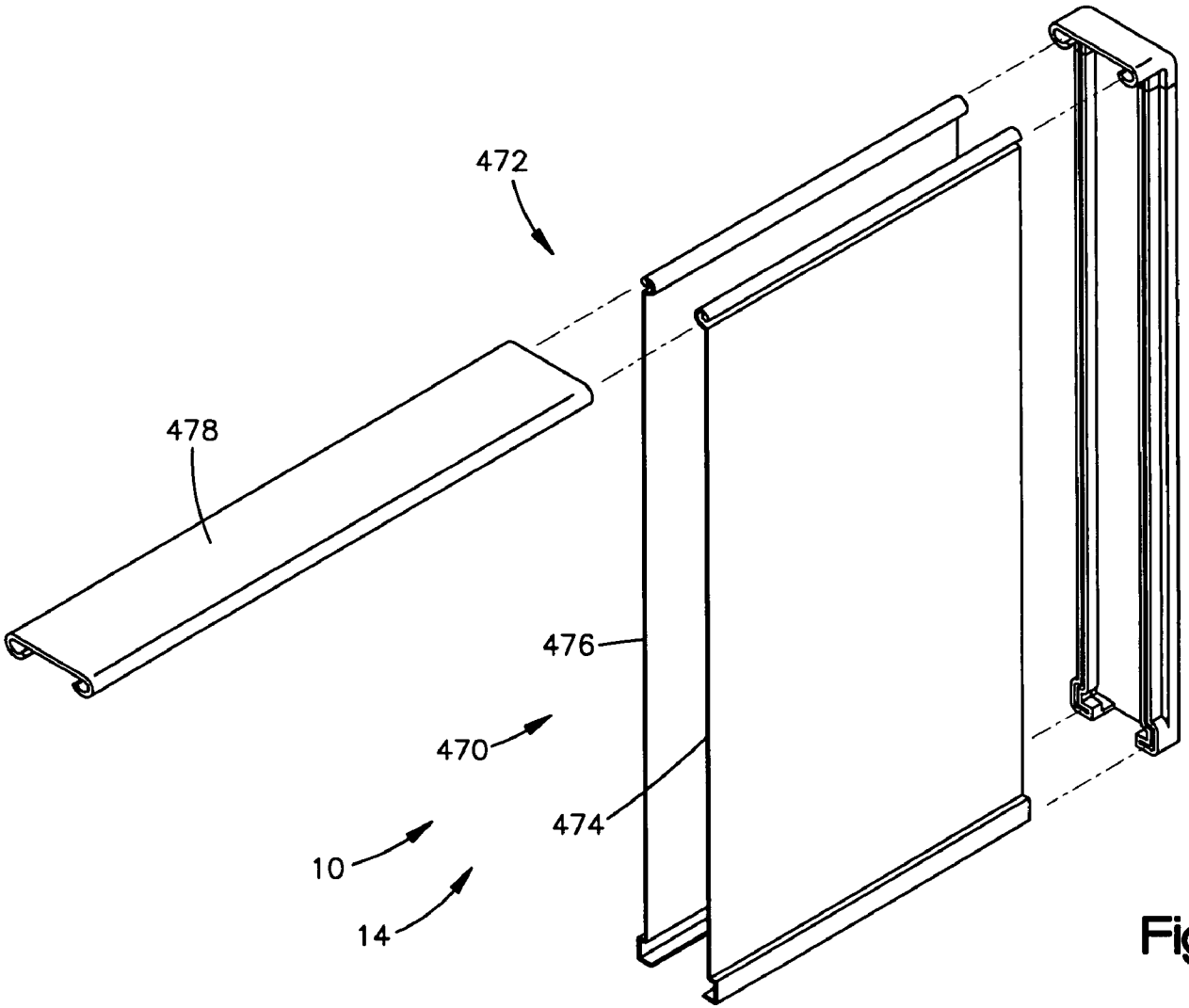
FIG. 21 is an exploded view of another alternative plastic bed end cover embodiment in accordance with the present invention.
Figure 22:
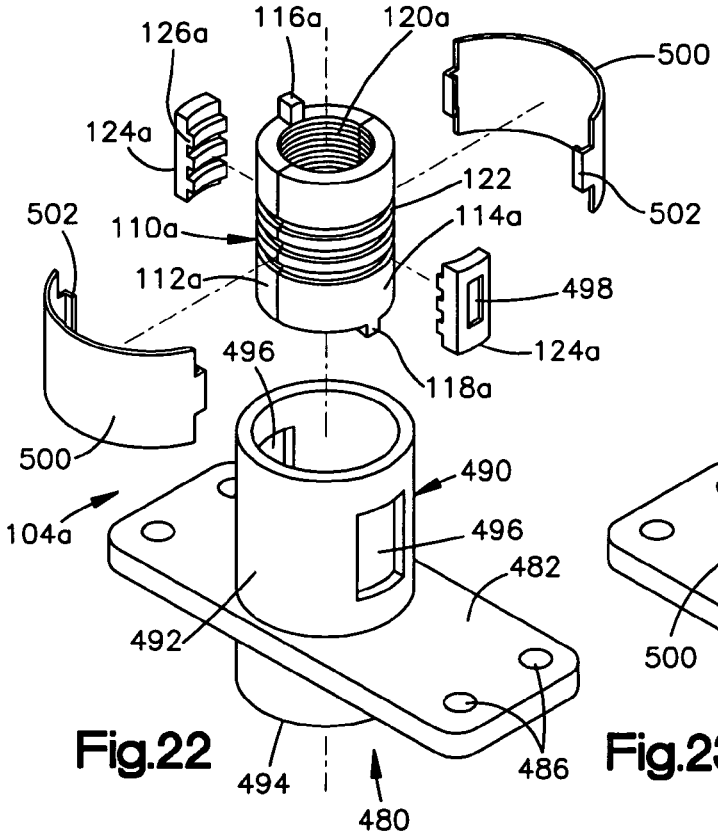
FIG. 22 is an exploded perspective view of an alternative slip nut assembly usable with the bed end of FIG. 2.
Figure 23:
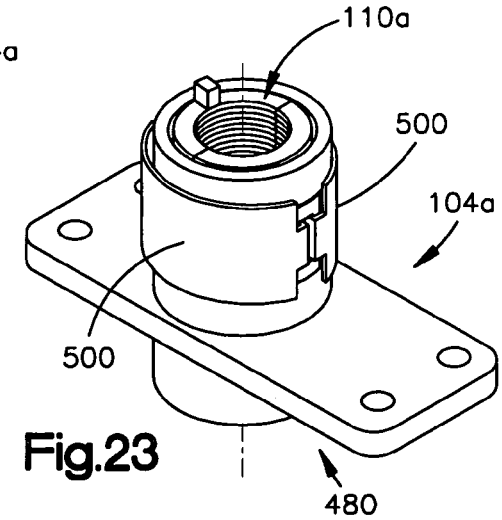
FIG. 23 is an assembled view of the slip nut assembly of FIG. 22.

The cover 400 illustrated in FIGS. 18 and 19 has two optional openings 418 extending through the bed end cover between the interior major side panel 402 and the exterior major side panel 404. The two openings 418 are disposed adjacent the upper edge portion 406 of the cover 400. Each one of the two openings 418 has a lower edge 420 that extends parallel to the lower edge portion 412 of the cover 400. As a result, a supporting assembly, such as a trapeze (not shown), can be clamped onto the bed end 14 between the lower edge 420 of one of the openings 418, and the lower edge portion 412 of the cover 400.

The cover 430 (FIG. 20) is another example of a plastic bed end cover that is constructed in accordance with the present invention. The cover 430 is a hollow cover for enclosing and covering the operational and structural assembly or parts of a bed end. The cover 430 has a three-piece plastic construction including a central panel 432 and two identical end caps 433 (only one of which is shown).

The central panel 432 is a one-piece extrusion preferably made from PVC. The central panel 432 includes an interior major side panel 434 that faces the opposite end of the bed 10 when assembled, and an opposite exterior major side panel 436. The panels 434 and 436 are joined by an upper edge panel 438 in an upside-down U-shaped configuration to form the central panel 432.

The interior major side panel 434 has a planar configuration with a rectangular rib 440 forming a bottom end portion of the panel. Similarly, the exterior major side panel 436 has a planar configuration with a rectangular rib 442 forming a bottom end portion of the panel. The upper edge panel 438 forms a similar rectangular configuration with the top edge portions 444 and 446 of the interior and exterior major side panels 434 and 436, respectively.

The end caps 433 may be made from ABS. The end cap 433 has a generally planar configuration. The end cap 433 has three flanges 450, 452 and 454 that matingly engage three edges, 456 of the central panel 432, to secure the end cap to the central panel. The end cap 433 has a more rigid construction than the central panel 432, and, as a result, can help to rigidify the assembled cover 430.

The cover 430 has an open bottom edge 462 for enabling sliding movement of the hollow cover over the operational and structural assembly in a direction between the upper edge panel 438 and the bottom edge of the cover, as indicated by the arrow 464.

This cover 430 is therefore easy to assemble to the structural and operational parts of the bed end 14 as shown in FIG.

2, for example. It is also easy to manufacture and handle, and has the other advantages discussed above with reference to the embodiment of FIGS. 18 and 19.

The cover 470 (FIG. 20) is a third example of a plastic bed end cover that is constructed in accordance with the present invention. The cover 470 is a hollow cover for enclosing and covering the operational and structural assembly.

The cover 470 is similar to the cover 430 (FIG. 20) with the exception that the central panel 472 in the cover 430 is made from three pieces, not one. Specifically, the central panel 470 is formed as an interior major side panel 474, an exterior major side panel 476, and an upper edge panel 478. The three panels 474-478 when joined together to form the central panel 472 have an upside-down U-shaped configuration. The cover 470 otherwise has the, all advantages and feature described above with respect to the cover 430 (FIG. 20).

FIGS. 22-25 illustrate an alternative slip nut assembly 104*a* for use in the bed end 10. The slip nut assembly 104*a* has some parts that are the same as or similar to the parts of the slip nut assembly 104 (FIGS. 2-4), and such parts are in FIGS. 22-25 given the same reference numerals with the suffix "a" added to distinguish them.

Figure 24:
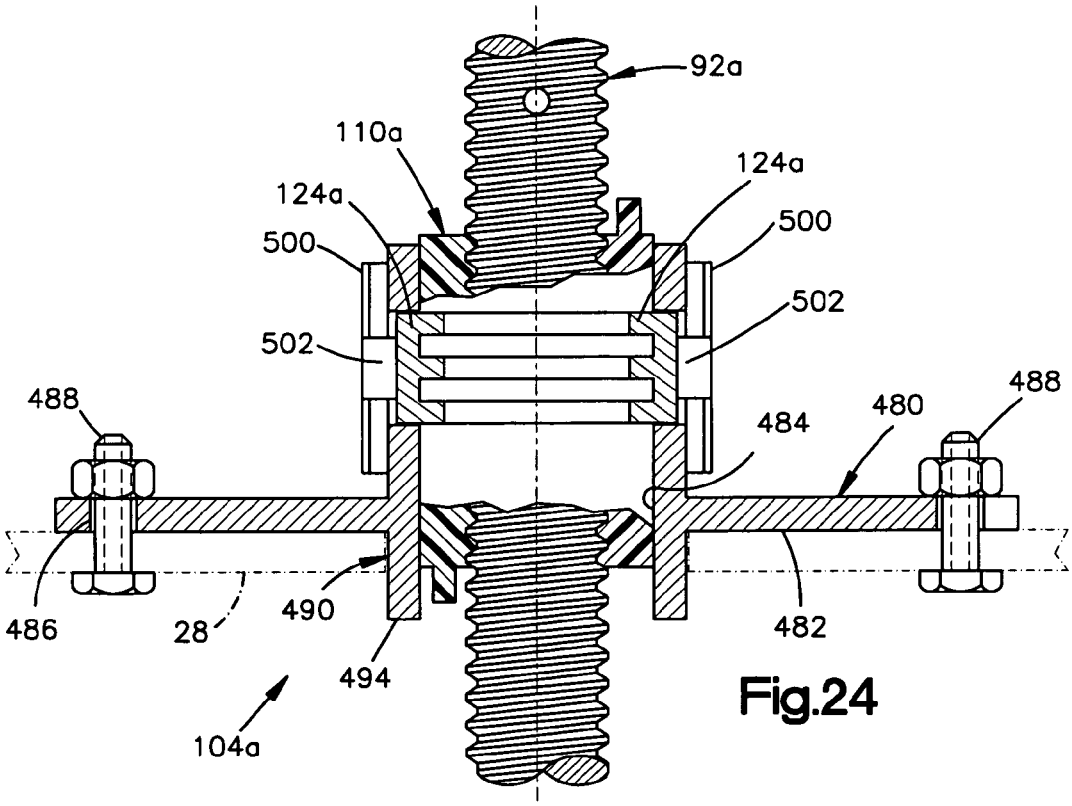
FIG. 24 is a sectional view of the slip nut assembly of FIG. 224.
Figure 25:
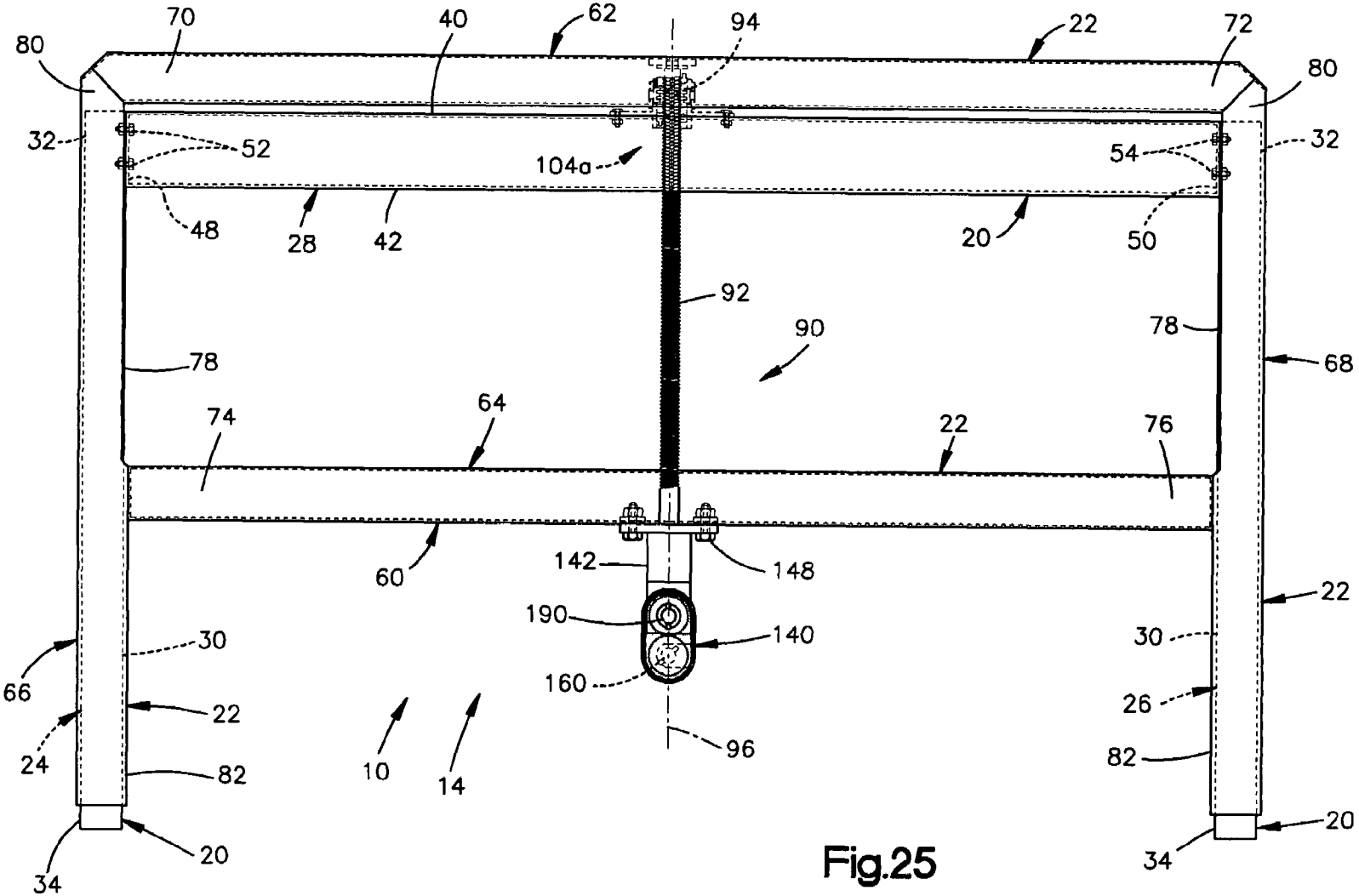
FIG. 25 is a view similar to FIG. 2 showing the slip nut assembly of FIG. 22 incorporated in the bed end of FIG. 2.

The slip nut assembly 104*a* includes a slip nut support 480. The support 480 includes a base plate 482 having a generally rectangular configuration. The base plate 482 has a circular central opening 484 (FIG. 24).

A plurality of bolt holes 486 are formed in the opposite ends of the base plate 482. Bolts 488 extend through the bolt holes 486 and fix the support 480 to the upper side wall 40 of the cross-beam 28, at a location inside the cross-beam. As a result, the slip nut support 480 is rigidly coupled by the cross-beam 28 to the inner legs 24 and 26 of the bed end 10.

The support 480 also includes a force transfer member in the form of a hollow, cylindrical shell 490 at the center of the base plate 482. The shell 490 either is formed separately from the base plate 482 and fixed to it, or is formed as one piece with the base plate. The shell 490 includes a first or upper portion 492 that extends above the base plate 482 and a second or lower portion 494 that extends below the base plate. Two diametrically opposed, rectangular, pressure plate openings 486 are formed in the upper portion 492 of the shell 490.

The slip nut assembly 104*a* also includes a slip nut 110*a*. The slip nut 110*a* may be the same as the slip nut and thus is formed as two separate pieces 112*a* and 114*a*. The first and second slip nut halves 112*a* and 114*a* are formed by casting or molding. The first and second slip nut halves 112*a* and 114*a* are identical to each other.

An upper slip nut pin 116*a* is formed as one piece with the first slip nut half 112*a*. A lower slip nut pin 118*a* is formed as one piece with the second slip nut half 114*a*. The upper and lower slip nut pins 116*a* and 118*a* project axially from opposite upper and lower end surfaces of the slip nut 110*a*. The two slip nut halves 112*a* and 114*a* when placed together define an internal thread convolution 120*a* into which the lead screw 92*a* is threaded. A plurality of circumferential grooves 122*a* are formed on the outer surface of the slip nut 110*a*. The grooves 122*a* do not extend helically but rather extend perpendicular to the drive axis 96*a*.

The slip nut assembly 104*a* further includes a pair of pressure plates 124*a*. The pressure plates 124*a* have internal grooves 126*a* that mesh with the external grooves 122*a* on the slip nut 110*a* to provide for relative rotation, without relative axial movement, between the slip nut and the pressure plates. Each pressure plate 124*a* on its curved exterior surface has a recess or notch 498.

A pair of springs 500 are associated with the pressure plates 124*a*. In the embodiment illustrated in FIGS. 22-25, the springs 500 are leaf springs. Each leaf spring 500 has a generally rectangular overall configuration, and is formed into an arcuate shape extending about 180 degrees. Each spring 500 has opposite end portions 502 that are formed as hooks or tabs adapted to engage in a respective notch 498 in one of the pressure plates 124*a*.

The slip nut 110*a* is disposed in the shell 490 of the support 480. The slip nut 110*a* is threaded on the lead screw 92*a* so that relative rotational movement between the lead screw and the slip nut results in relative axial movement between the lead screw and the slip nut.

The pressure plates 124*a* are supported on the exterior of the slip nut 110*a* as described above and are located in the pressure plate openings 496 in the upper portion 492 of the shell 490. The engagement of the pressure plates 124*a* in the pressure plate openings 496 in the shell 490 substantially blocks movement of the pressure plates relative to the shell in any direction other than a radial direction. The engagement of the pressure plates 124*a* in the pressure plate openings 496 in the shell 490 also enables force to be transferred from the slip nut 110 through the pressure plates into the shell of the support 480.

The leaf springs 500 extend around the upper portion 492 of the shell 490. Each leaf spring 500 has its opposite end portions 502 engaged in the spring notches 498 of the two pressure plates 124*a*. Between them, the two leaf springs 500 extend for substantially the entire 360 degree circumference of the shell 490 and thus of the slip nut 110*a*.

The arcuate configuration of the leaf springs 500 causes the leaf springs to exert a radially inwardly directed biasing force on the pressure plates 124*a*. Specifically, the end portions 502 of the leaf springs 500 press radially inward on the pressure plates 124*a*, holding the pressure plates against the outer surface of the slip nut 110*a*. The springs 500 thus urge the pressure plates 124*a* radially inward against the slip nut halves 112*a* and 114*a*, which are, thereby, urged radially inward against the lead screw 92*a*.

The slip nut assembly 104*a* is operative to limit upward and downward travel of the movable portion 22*a* of the head end 14*a* of the bed 10*a*, in a manner similar to that described above with reference to the slip nut assembly 104 shown in FIGS. 2-4.

In comparison to the slip nut assembly 104, the slip nut assembly 104*a* includes springs (the leaf springs 500) that support themselves on the pressure plates 124*a*. Thus, there is no specific need for a housing to enclose and support the leaf springs 500, as there is in the case of the slip nut assembly 104. The leaf springs are completely exposed on their exterior, with no portion of them being forced radially inward to keep them in place exerting force on the pressure plates. This difference might make the slip nut assembly 104*a* less expensive to manufacture.

The slip nut assembly 104*a* is also usable with other height adjustment mechanisms. For example, the slip nut assembly 104*a* is also usable with the cable and pulley mechanism illustrated in FIG. 8.

From the above description of the invention, those skilled in the art will perceive improvements, changes, and modifications in the invention. Such improvements, changes, and modifications within the skill of the art are intended to be included within the scope of the appended claims.

Having described the invention, I claim:

1. A bed end for a bed having a patient support that is adjustable vertically relative to a floor on which the bed is placed, said bed end comprising:

a lead screw rotatable in first and second opposite directions of rotation to effect raising and lowering of a movable portion of said bed end;

a slip nut assembly for transmitting vertical force from said lead screw to said movable portion of the bed to adjust the patient support vertically;

said slip nut assembly including a slip nut threadedly engaged with said lead screw, said slip nut being formed in two pieces;

said slip nut having a first condition in which it is fixed against rotation within said movable portion of said bed thereby to transmit vertical force from said lead screw to said movable portion of the bed when said lead screw rotates;

said slip nut having a second condition in which it is rotatable within said movable portion of said bed with said lead screw thereby to block transmission of vertical force from said lead screw to said movable portion of the bed;

said slip nut assembly including first and second leaf springs and pressure plates operative to bias said slip nut into engagement with said lead screw; and wherein each one of said leaf springs has opposite end portions engaged in recesses in said pressure plates.

2. A bed end as set forth in claim 1 wherein said pressure plates comprise first and second pressure plates engageable with said slip nut, said leaf springs biasing said pressure plates into engagement with said slip nut.

3. A bed end as set forth in claim 2 wherein said each one of said slip nut pieces has an arcuate configuration extending about 180 degrees and each one of said leaf springs has an arcuate configuration extending about 180 degrees about said slip nut.

4. A bed end as set forth in claim 1 wherein said two pieces of said slip nut are identical to each other.

5. A bed end as set forth in claim 4 wherein each one of said two pieces of said slip nut has an axially extending portion for engagement with a radially projecting portion of said lead screw, said axially extending portions of said two slip nut pieces extending in opposite axial directions.

6. A bed end as set forth in claim 1 wherein said first and second leaf springs are self-supporting on said slip nut assembly.

7. A bed end for a bed having a patient support that is adjustable vertically relative to a floor on which the bed is placed, said bed end comprising:

a lead screw rotatable in first and second opposite directions of rotation to effect raising and lowering of a movable portion of said bed end;

a slip nut assembly for transmitting vertical force from said lead screw to said movable portion of the bed to adjust the patient support vertically;

said slip nut assembly including a slip nut threadedly engaged with said lead screw, said slip nut being formed in two pieces;

said slip nut having a first condition in which it is fixed against rotation within said movable portion of said bed thereby to transmit vertical force from said lead screw to said movable portion of the bed when said lead screw rotates;

said slip nut having a second condition in which it is rotatable within said movable portion of said bed with said lead screw thereby to block transmission of vertical force from said lead screw to said movable portion of the bed;

said slip nut assembly including first and second leaf springs and pressure plates operative to bias said slip nut into engagement with said lead screw; and wherein said first and second leaf springs are exposed on their exterior, having no portion being forced radially inward against said pressure plates.

8. A bed end for a bed having a patient support that is adjustable vertically relative to a floor on which the bed is placed, said bed end comprising:

a lead screw rotatable in first and second opposite directions of rotation to effect raising and lowering of a movable portion of said bed end;

a slip nut assembly for transmitting vertical force from said lead screw to said movable portion of the bed to adjust the patient support vertically;

said slip nut assembly including a slip nut threadedly engaged with said lead screw;

said slip nut having a first condition in which it is fixed against rotation within said movable portion of said bed thereby to transmit vertical force from said lead screw to said movable portion of the bed when said lead screw rotates;

said slip nut having a second condition in which it is rotatable within said movable portion of said bed with said lead screw thereby to block transmission of vertical force from said lead screw to said movable portion of the bed;

said slip nut assembly including first and second leaf springs operative to inhibit rotation of the slip nut upon rotation of said lead screw; and a driveshaft that is rotatable in first and second opposite directions of rotation about a first axis to raise and lower said movable portion of said bed end, said lead screw being rotatable about a second axis transverse to said first axis, said bed end further comprising a gearbox connected with said lead screw for transmitting rotational force from the driveshaft to said lead screw;

wherein said gearbox can be coupled with the driveshaft in a first condition receiving rotational force from the driveshaft in a first direction of rotation about said first axis and effecting rotation of said lead screw about said second axis in a direction so as to raise said movable portion of said bed end; and wherein said gearbox can be coupled with said driveshaft in a second condition receiving rotational force from the driveshaft in said first direction of rotation about said first axis and effecting rotation of said lead screw about said second axis in a direction so as to lower said movable portion of said bed end.

9. A bed end as set forth in claim 8 wherein said gearbox includes first and second input shafts, said first input shaft being coupled with the driveshaft when said gearbox is in the first condition and said second input shaft being coupled with the driveshaft when said gearbox is in the first condition.

10. A bed end as set forth in claim 8 wherein said gearbox has an input shaft that is selectively movable in a housing between first and second positions relative to said housing, said input shaft being in the first position when said gearbox is in the first condition and said input shaft being in the second position when said gearbox is in the second condition.

11. A bed end as set forth in claim 10 wherein said input shaft includes first and second gears spaced along said input shaft and movable into and out of engagement with an output gear in response to movement of said input shaft between the first and second positions.

* * * * *